US009951781B2

(12) United States Patent
Choi et al.

(10) Patent No.: US 9,951,781 B2
(45) Date of Patent: Apr. 24, 2018

(54) CENTRIFUGAL BLOWER AND AIR CONDITIONER USING THE SAME

(71) Applicant: LG ELECTRONICS INC., Seoul (KR)

(72) Inventors: Woojoo Choi, Seoul (KR); Choonmyun Chung, Seoul (KR); Dongkyun Im, Seoul (KR); Taeman Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 718 days.

(21) Appl. No.: 14/329,469

(22) Filed: Jul. 11, 2014

(65) Prior Publication Data

US 2015/0013945 A1 Jan. 15, 2015

(30) Foreign Application Priority Data

Jul. 12, 2013 (KR) ..... 10-2013-0082135

(51) Int. Cl.
*F04D 17/10* (2006.01)
*F24F 7/007* (2006.01)
(Continued)

(52) U.S. Cl.
CPC ..... *F04D 17/10* (2013.01); *F24F 1/0007* (2013.01); *F24F 1/0022* (2013.01); *F24F 7/007* (2013.01);
(Continued)

(58) Field of Classification Search
CPC ..... F04D 17/10; F04D 17/16; F04D 29/4213; F04D 29/4226; F04D 29/441;
(Continued)

(56) References Cited

U.S. PATENT DOCUMENTS

2004/0244403 A1* 12/2004 Kim ..... F04D 17/165 62/419

FOREIGN PATENT DOCUMENTS

| | | | |
|---|---|---|---|
| CN | 1508440 | 6/2004 | |
| CN | 1573251 | 2/2005 | |
| CN | 101290147 | 10/2008 | |
| CN | 102272530 | * 12/2011 | ..... F24F 1/00 |
| CN | 202789746 | * 3/2013 | ..... F04D 29/44 |
| GB | 2 451 152 A | 1/2009 | |
| JP | 10-141694 | 5/1998 | |
| JP | H10-153196 A | 6/1998 | |
| JP | H11-101194 A | 4/1999 | |

(Continued)

OTHER PUBLICATIONS

English translation of Lihua (CN202789746).*

(Continued)

*Primary Examiner* — Jianying Atkisson
*Assistant Examiner* — Joel Attey
(74) *Attorney, Agent, or Firm* — Ked & Associates LLP

(57) ABSTRACT

A centrifugal blower for an air conditioner may include a centrifugal fan rotatably coupled to a motor, and a bell mouth guiding air into the centrifugal fan. The centrifugal fan may include a hub fixed to the motor, a main plate provided at an outer circumferential surface of the hub, a shroud surrounding the rotary shaft, the shroud positioned opposite the main plate to define a main gas flow path, and wings arranged along a circumferential direction of the suction opening between the main plate and the shroud. A rear axial end of the bell mouth may be inserted into the shroud through the suction opening so as to form a predetermined radial gap with the suction opening. A rear portion of the bell mouth may include alternately formed protrusions and recesses inserted into the shroud.

18 Claims, 21 Drawing Sheets

(51) Int. Cl.

| | |
|---|---|
| ***F24F 1/00*** | (2011.01) |
| *F04D 25/08* | (2006.01) |
| *F04D 25/12* | (2006.01) |
| *F04D 29/44* | (2006.01) |
| *F04D 29/42* | (2006.01) |
| *F04D 17/16* | (2006.01) |

(52) U.S. Cl.
CPC ..... *F04D 17/16* (2013.01); *F04D 25/08* (2013.01); *F04D 25/082* (2013.01); *F04D 25/088* (2013.01); *F04D 25/12* (2013.01); *F04D 29/4213* (2013.01); *F04D 29/4226* (2013.01); *F04D 29/441* (2013.01); *F24F 2001/0037* (2013.01)

(58) Field of Classification Search
CPC ..... F04D 25/08; F04D 25/082; F04D 25/088; F04D 25/12; F24F 1/0007; F24F 1/0022; F24F 7/007; F24F 2001/0037
USPC ..... 165/121
See application file for complete search history.

(56) References Cited

FOREIGN PATENT DOCUMENTS

| | | | | |
|---|---|---|---|---|
| JP | 2007-40617 | | 2/2007 | |
| JP | 2007040617 | * | 2/2007 | ..... F04D 29/28 |
| JP | 2012-211577 | | 11/2012 | |
| WO | WO 2004/079270 A1 | | 9/2004 | |

OTHER PUBLICATIONS

English translation of In-Ho (CN102272530).*
English translation of Hiroyasu (JP2007040617).*
European Search Report dated Nov. 18, 2014 issued in Application No. 14 176 707.9.
Chinese Office Action dated Mar. 29, 2016 (English Translation).
Chinese Office Action dated Dec. 2, 2016. (English Translation).

* cited by examiner

CENTRIFUGAL BLOWER AND AIR CONDITIONER USING THE SAME

CROSS-REFERENCE TO RELATED APPLICATION(S)

This application claims priority under 35 U.S.C. § 119 to Korean Application No. 10-2013-0082135 filed in Korea on Jul. 12, 2013, whose entire disclosure is hereby incorporated by reference.

BACKGROUND

1. Field

This relates to a centrifugal blower and, more particularly, to a centrifugal blower having reduced noise and improved efficiency.

2. Background

An air conditioner may provide cooling or heating to a space using a refrigeration cycle including a compressor, an outdoor heat exchanger, an expansion valve, and an indoor heat exchanger. Such an air conditioner may function as a cooler for cooling a space or as a heater for heating a space, or as an air conditioner for both cooling and heating a space.

An air conditioner may include an indoor unit provided, for example, at a ceiling of an indoor space to be heated/cooled so as to convey heated/cooled air into the indoor space, an outdoor unit installed outdoors, and a refrigerant pipe connecting the indoor unit and the outdoor unit to each other. The indoor unit may be installed in a main body, and a blower may draw indoor air through the indoor unit and then exhaust the air passing through the indoor unit into the indoor space. Such an air conditioner may instead be mounted on a wall of the space to be heated/cooled. In both of these arrangements, a heat exchanger may be disposed at the exhaust side of a centrifugal fan. A heat dissipation hole may be formed in a hub adjacent to a fan motor for cooling. However, such a heat dissipation hole may cause friction with air drawn into the unit, which generate noise and reduce efficiency of the fan.

BRIEF DESCRIPTION OF THE DRAWINGS

The embodiments will be described in detail with reference to the following drawings in which like reference numerals refer to like elements wherein.

DETAILED DESCRIPTION

Figure 1:
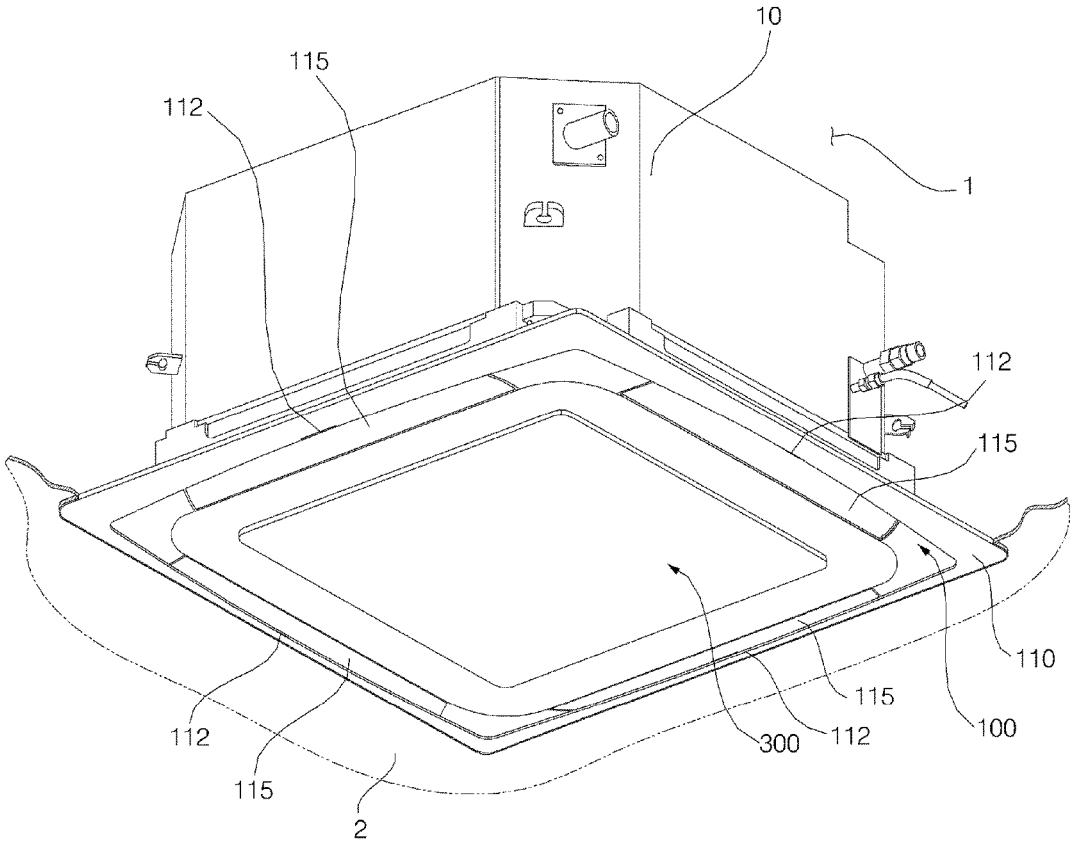
FIGS. 1 and 2 are perspective views of an air conditioner as embodied and broadly described herein, FIG. 1 being during operation and FIG. 2 with operation stopped.
Figure 2:
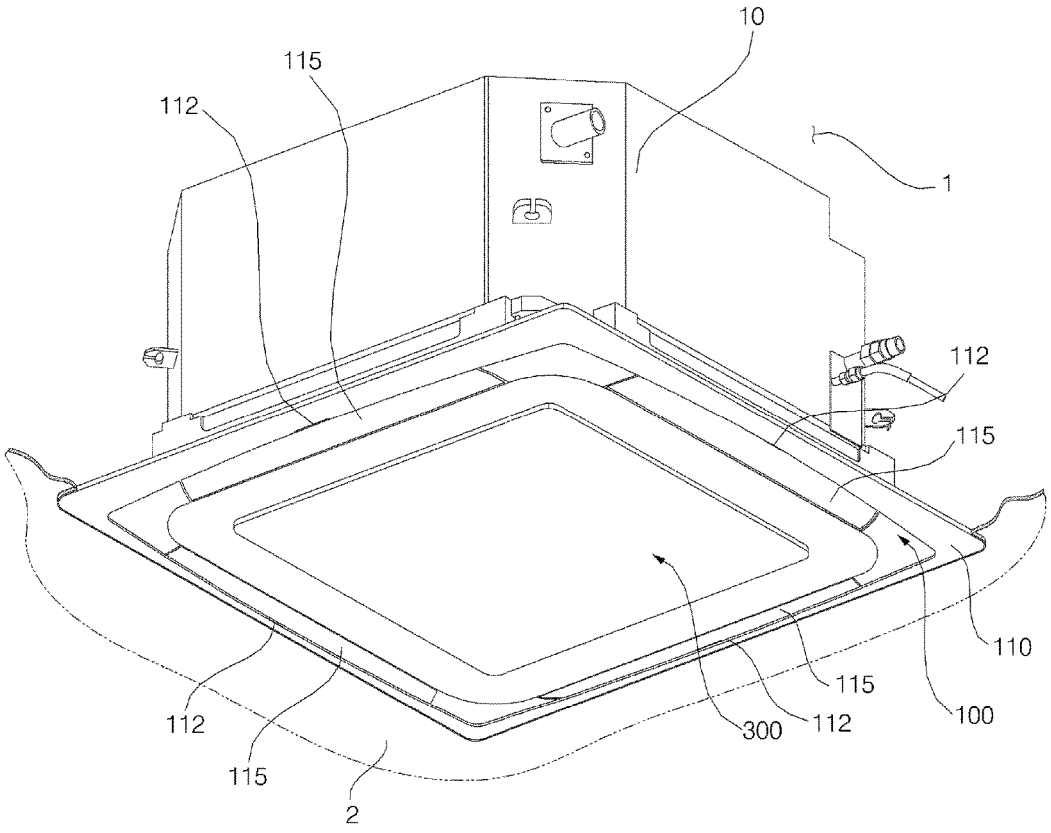

Embodiments will be described more fully hereinafter with reference to the accompanying drawings. Embodiments should not be construed as limited to the exemplary embodiments as broadly described herein. Rather, these exemplary embodiments are provided for thoroughness and completeness, so as to convey the scope to those skilled in the art. In the drawings, the thickness of layers, films and regions may be exaggerated for clarity. Like numerals will refer to like elements wherever possible.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" may encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting. As used herein, the singular terms "a," "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence and/or addition of one or more other features, integers, steps, operations, elements, components, and/or groups thereof.

Unless otherwise defined, all terms (including technical and scientific terms) used herein may have the same meaning as what is commonly understood by one of ordinary skill in the art. It will be further understood that terms, such as those defined in commonly used dictionaries, should be interpreted as having a meaning that is consistent with their meaning in the context of the relevant art and will not be interpreted in an idealized and/or overly formal sense unless expressly so defined herein.

As shown in FIGS. 1 to 4, an air conditioner as embodied and broadly described herein may include a main body 10 disposed between a ceiling 1 and a ceiling board 2 disposed below the ceiling 1, a blower 12 installed in the main body 10, a heat exchanger 14 mounted around the blower 12 inside the main body 10, and an inlet/outlet panel assembly 100 having an air inlet through which air is drawn into the main body 10.

The main body 10 may be formed in the shape of, for example, a rectangular parallelepiped or regular hexahedron, with an opened lower surface.

The blower 12, suctioning and exhausting indoor air, and the heat exchanger 14, exchanging heat with the air, may be disposed inside the main body 10.

Refrigerant which has been cooled in an external outdoor unit may undergo heat-exchange with the indoor air in the heat exchanger 14. The heat exchanger 14 may be connected to the outdoor unit by a pipe.

The air conditioner according to this embodiment may be configured as a one way air conditioner having one air inlet and one air outlet, or may be configured as a four way air conditioner having one air inlet and four air outlets. In a case where the air conditioner is configured as a one way air conditioner, the blower 12 and the heat exchanger 14 may be disposed at the left and right, or at the front and rear inside the main body 10. In a case where the air conditioner is configured as a four way air conditioner, the heat exchanger 14 may surround the blower 12 around a periphery of the blower 12. Hereinafter, the four way air conditioner will be described as an example.

The blower 12 may be a centrifugal blower that draws air from below and blows the air radially outward. The blower 12 may include a fan motor 15 mounted to an upper plate portion of the main body 10 so that a rotary shaft 151 protrudes downward, and a centrifugal fan 16 connected to the rotary shaft 151 of the fan motor 15.

The heat exchanger 14 may include front, rear, left and right portions surrounding the periphery of the blower 12.

The inlet/outlet panel assembly 100 may cover a main body mounting hole formed in the ceiling board 2, and may be mounted at a lower portion of the main body 10 to define a lower surface of the air conditioner.

The inlet/outlet panel assembly 100 may include an air inlet 205 which may be opened so that the indoor air beneath the blower 12 may be drawn into the main body 10, and air outlets 112 respectively formed at front, rear, left and right sides of the air inlet 205, spaced apart from one another along the periphery of the air inlet 205.

The inlet/outlet panel assembly 100 may include one inlet/outlet panel in which the air inlet 205 and the air outlets 112 are all formed. Alternatively, the inlet/outlet panel assembly 100 may include an outlet panel 110 having the air outlets 112 formed therein and an inlet panel 200 having the air inlet 205 formed therein.

In FIGS. 3-8, the arrow F may refer to a front axial direction progressing toward a front axial end F of the air conditioner, and the arrow R may refer to a rear axial direction progressing toward a rear axial end R of the air conditioner, corresponding to the intake and discharge of air, respectively.

The air inlet 205 may vertically overlap with the blower 12. That is, the rotary shaft 151 of the centrifugal fan 16 and the center of the air inlet 205 may vertically overlap with each other. The air inlet 205 may be positioned further front, toward the front axial end F (the bottom based on the orientation shown in FIG. 3) than the centrifugal fan 16.

A purification device 210 purifying the air drawn in through the air inlet 205 may be disposed in the inlet/outlet panel assembly 100. The purification device 210 may be mounted on the inlet/outlet panel assembly 100 so as to be positioned at the upper end of the air inlet 205.

In a case where the outlet and inlet panels 110 and 200 are separately configured and the inlet panel 200 is to attached to/detached from the outlet panel 110, the purification device 210 and an ascending/descending mechanism 230, or raising and lowering mechanism 230, may be conveniently serviced by separating only the inlet panel 200 from the outlet panel 110, without separating the entire inlet/outlet panel assembly 100 from the main body 10. Hereinafter, it will be described that the outlet and inlet panels 110 and 200 are separately configured and the inlet panel 200 is attached to/detached from the outlet panel 110.

Exhaust vanes 115 and an exhaust vane driving mechanism may be provided in the inlet/outlet panel assembly 100. The exhaust vanes 115 may open/close the air outlets 112 and control the direction of air exhausted through the air outlets 112 when the air outlets 112 are opened. The exhaust vane driving mechanism may rotate the exhaust vanes 115 to open/close the air outlets 112 and control a flow direction through the outlets 112.

The exhaust vanes 115 may be rotatably positioned in the respective the air outlets 112. The exhaust vane driving mechanism may rotate one exhaust vane 115 or a plurality of exhaust vanes 115.

A door panel 300 covering the air inlet 205 may be disposed in the inlet/outlet panel assembly 100. The door panel 300 may serve as an air guide which is spaced apart from the inlet panel 200 when descending so at to guide the suction of air, and may cover the inlet panel 200 when ascending so that foreign matter such as dust does not penetrate between the inlet panel 200 and the door panel 300. The door panel 300 may function as a kind of screen so that the air inlet 205 is not overly visible indoors, regardless of the height of the door panel 300

A size of the door panel 300 may correspond to that of the air inlet 205 or may be greater than that of the air inlet 205.

In certain embodiments, a size of the door panel 300 may be greater than the inlet panel 200 so as to cover the inlet panel 200 and screen the entire inlet panel 200 when ascending. That is, the outlet panel 110 may form the external appearance of a portion of the lower surface of the air conditioner, and the door panel 300 may form the external appearance of the rest of the lower surface of the air conditioner.

When the air conditioner is operated, the door panel 300 may descend and be positioned lower than the inlet/outlet panel assembly 100. When the air conditioner is stopped, the door panel 300 may ascend to be positioned at the same height as the inlet/outlet panel assembly 100 or to be positioned so as to contact a lower surface of the inlet/outlet panel assembly 100. The ascending/descending mechanism 230 may lower the door panel 300 to form an air suction flow path P, or may raise the door panel 300 to shield the inlet panel 200, and may be disposed in at least one of the inlet/outlet panel assembly 100 or the door panel 300. A bell mouth 17 may be positioned at the air inlet 205 of the inlet/outlet panel assembly 100 so as to guide air to the blower 12.

Figure 5:
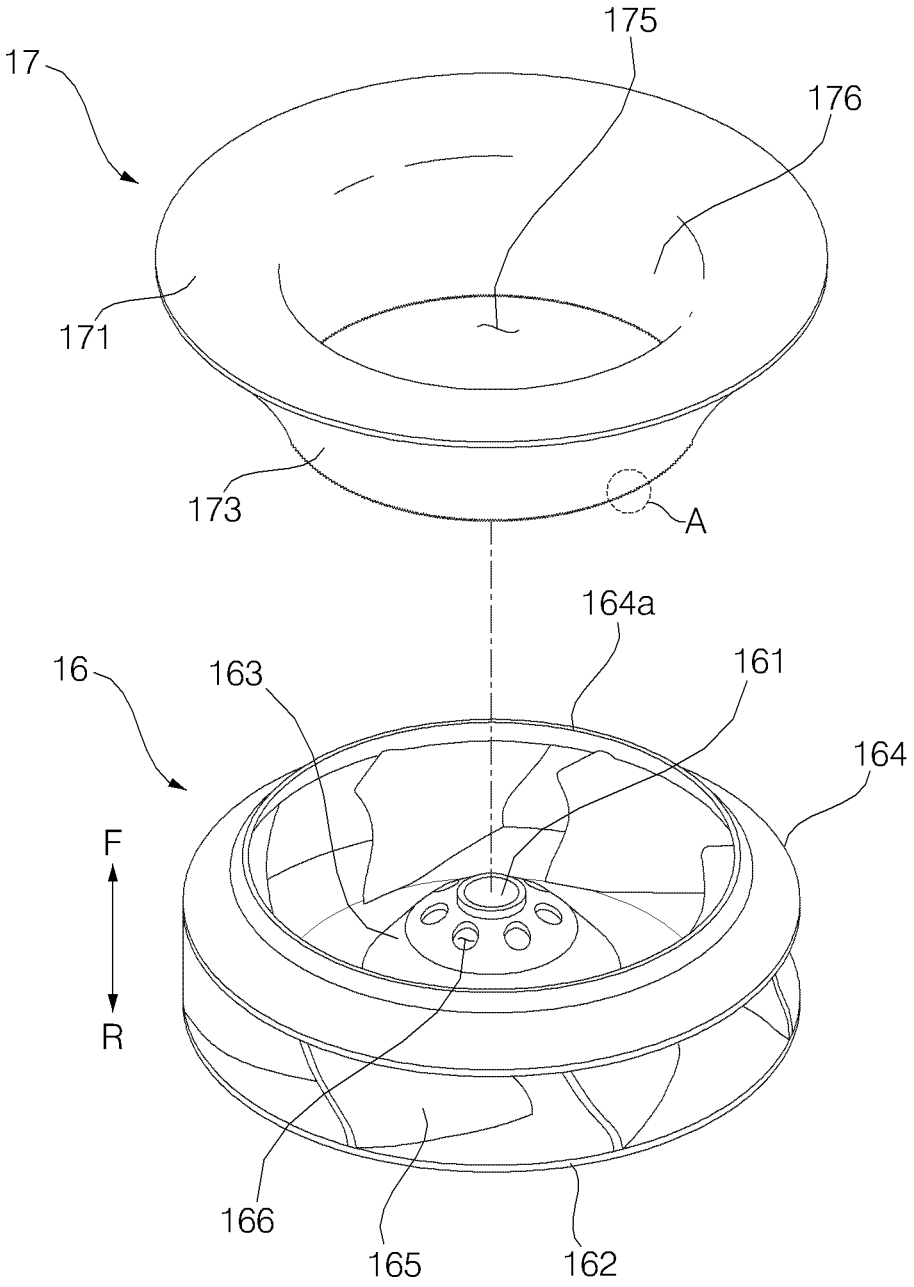
FIG. 5 is a perspective view of a bell mouth and a centrifugal fan, in accordance with an embodiment as broadly described herein.
Figure 6:
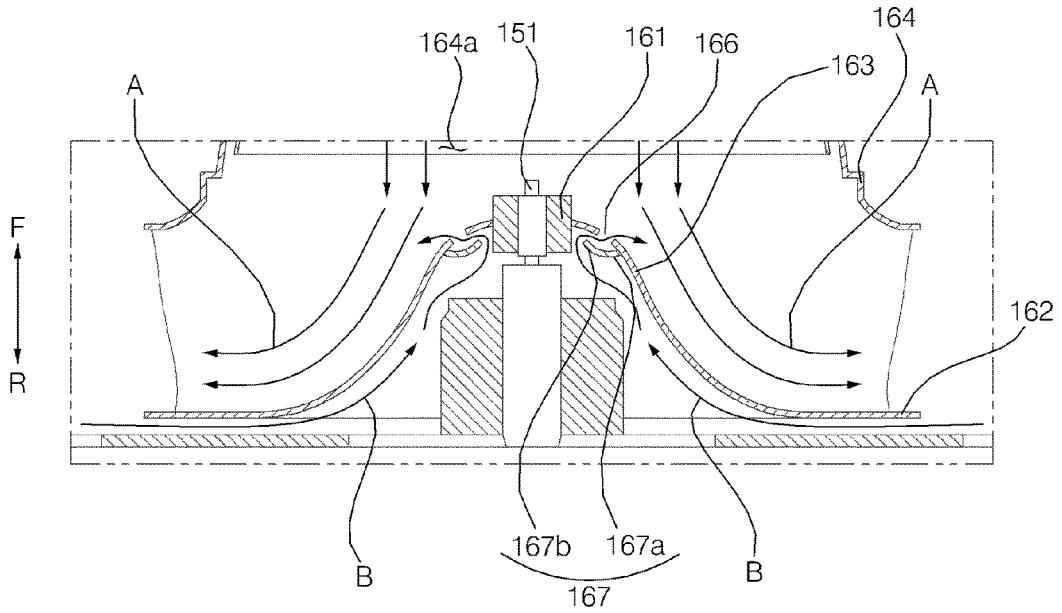
FIG. 6 is a sectional view of the centrifugal fan shown in FIG. 5.

FIG. 5 is a perspective view of a bell mouth and a centrifugal fan according to an embodiment as broadly described herein, and FIG. 6 is a sectional view of the centrifugal fan.

Referring to FIGS. 3 to 6, the centrifugal fan 16 may include a hub 161, an extending plate 163, a main plate 162, a shroud 164 and a plurality of wings 165. That is, the hub 161 may be fixed to the rotary shaft 151 of the fan motor 15, with the extending plate 163 extending in the rear axial direction R from the outer circumference of the hub 161 so as to provide a space in which the fan motor 15 is positioned. The main plate 162 may be formed on the outer circumference of the extending plate 163, and the shroud 164 may have a suction opening 164*a* formed about the rotary shaft 151, and disposed opposite the main plate 162, toward the front axial direction F with respect to the main plate 162, so as to form a main gas flow path A. The plurality of wings 165 may be arranged along the circumferential direction of the suction opening 164*a*, between the main plate 162 and the shroud 164.

The hub 161 may be fixed to the rotary shaft 151 of the fan motor 15. The hub 161 may be formed in a circular shape about the rotary shaft 151. The hub 161 may be coupled to the fan motor 15 so as to be rotated together with the rotary shaft 151 of the fan motor 15.

The extending plate 163 may extend in the rear axial direction R from the outer circumference of the hub 161 so as to provide the space in which the fan motor 15 is positioned. The extending plate 163 may have a slope such that the size of the space in which the fan motor 15 is positioned increases as the space approaches the rear axial direction R. That is, the extending plate 163 may be formed so that the external diameter of the space in which the fan motor 15 is positioned, which is formed by the extending plate 163, increases when progressing along the rear axial direction R. In other words, the sectional shape of the space may be a bell shape with a width which is widened as the space approaches the rear axial direction R, and may be formed concavely about the hub 161.

The extending plate 163 may connect the outer circumference of the hub 161 to the inner circumference of the main plate 162, and may provide the space in which the fan motor 15 is positioned.

The main gas flow path A forms a path through which air flows to the inside of the centrifugal fan 16 through the suction opening 164*a* of the shroud 164 due to a pressure difference generated by the rotation of the centrifugal fan 16 and then exhausted in the circumferential direction of the suction opening 164*a* (the space between the shroud 164 and the main plate 162) from the inside of the centrifugal fan 16. That is, the main gas flow path A forms a path through which the air is drawn from the front axial end F in the rear axial direction R and is then exhausted in a radial direction with respect to the rotary shaft 151.

The extending plate 163 may prevent a decrease in performance caused when the direction of the main gas flow A is suddenly changed, and may reduce noise. That is, the extending plate 163 may be inclined to gradually change the direction of the main gas flow A from the axial direction to the circumferential direction of the suction opening 164*a*.

The main plate 162 may be formed at the outer circumference of the extending plate 163. The hub 161, the extending plate 163 and the main plate 162 may be integrally formed, but embodiments are not limited thereto. The main plate 162 may provide a space in which the plurality of wings 165 are positioned.

The shroud 164 may be disposed opposite the main plate 162 in the front axial direction F with respect to the main plate 162 so as to provide a space in which the main gas flow A is formed. That is, the shroud 164 forms the path for the main gas flow A.

The suction opening 164*a* of the shroud 164 is open about the rotary shaft 151. The external diameter of the shroud 164 increases as the shroud 164 approaches the rear axial direction R from the front axial direction F.

As shown in FIG. 6, the main gas flow A forms a path through which air is drawn into the centrifugal fan 16 through the suction opening 164*a* of the shroud 164 due to a pressure difference generated by the rotation of the centrifugal fan 16 and then exhausted in the circumferential direction of the suction opening 164*a* (the space between the shroud 164 and the main plate 162) from the inside of the centrifugal fan 16. That is, the main gas flow A forms a path through which the air is drawn from the front axial end F toward the rear axial direction R and then exhausted in a radial direction with respect to the rotary shaft 151.

The bell mouth 17 and the air inlet 205 may be disposed at the front of the suction opening 164*a* to guide indoor air to the suction opening 164*a*.

The plurality of wings 165 may be arranged at predetermined intervals along the circumferential direction of the suction opening 164*a*, between the main plate 162 and the shroud 164. The end portion of each wing 165 at the front F may be connected to the inner surface of the shroud 164. The end portion of each wing 165 at the rear R may be connected to the main plate 162. Each wing 165 may be inclined in the opposite direction (backward) to the rotational direction with respect to the radial direction of the hub 161. The plurality of wings 165 may be arranged at the same interval along the circumference about the rotary shaft 151 between the main plate 162 and the shroud 164. The plurality of wings 165 may be rotated by the rotation of the main plate 162, so as to generate a pressure difference between the inside and outside of the centrifugal fan 16. This pressure difference may generate the main gas flow A described above.

One or more heat dissipation holes 166 and a direction changing portion may also be formed in the extending plate 163. The heat dissipation hole 166 may form a motor heat dissipation flow path B between the main plate 162 and the shroud 164 in the space in which the fan motor 15 is positioned in order to dissipate heat generated by the fan motor 15. The heat dissipation hole 166 may be formed in the extending plate 163. A plurality of heat dissipation holes 166 may be circumferentially arranged about the hub 161.

A pressure difference may be generated between the inside of the centrifugal fan 16 (the space between the shroud 164 and the main plate 162) and the space in which the fan motor 15 is positioned (the rear R of the hub 161 and the extending plate 163) due to the pressure difference generated by the rotation of the centrifugal fan 16. The pressure difference of air may generate the motor heat dissipation flow B.

The motor heat dissipation flow B may be formed from the space in which the fan motor 15 is positioned (the rear R of the hub 161 and the extending plate 163) to the inside of the centrifugal fan 16 (the space between the shroud 164 and the main plate 162) through the heat dissipation hole 166 by the pressure difference of the air.

In this case, the main gas flow A advancing from the front axial direction F to the rear axial direction R collides with the motor heat dissipation flow B. This collision may reduce the amount of air exhausted from the centrifugal fan 16, and may generate noise. This collision may also decrease efficiency of the centrifugal fan 16.

The direction changing portion may change the direction of the motor heat dissipation flow B exhausted through the heat dissipation hole(s) 166. That is, the direction changing portion may change the direction of the motor heat dissipation flow B exhausted through the heat dissipation hole(s) 166 between the rear axial direction R and the radial direction (in a direction perpendicular to the rear axial direction R).

If the direction of the motor heat dissipation flow B exhausted through the heat dissipation hole(s) 166 is changed into a direction similar to the direction of the main gas flow A, the collision between the main gas flow A and the motor heat dissipation flow B may be decreased, and it may be possible to reduce noise generated by the collision. Further, since the main gas flow A and the motor heat dissipation flow B do not interfere with each other, the main gas flow A and the motor heat dissipation flow B may be increased.

As a result, the increased main gas flow A may increase the amount of air exhausted by passing through the heat exchanger 14 and may improve the performance of the air conditioner. Further, the increased motor heat dissipation flow B may more efficiently cool the fan motor 15.

The direction changing portion may be configured in various ways to change the direction of the motor heat dissipation flow B exhausted through the heat dissipation hole(s) 166.

For example, as shown in FIG. 6, a direction changing device 167 may have a first end 167*a* connected to the extending plate 163 and a second end 167*b* spaced apart from the extending plate 163 to cover at least the heat dissipation hole 166.

Figure 7:
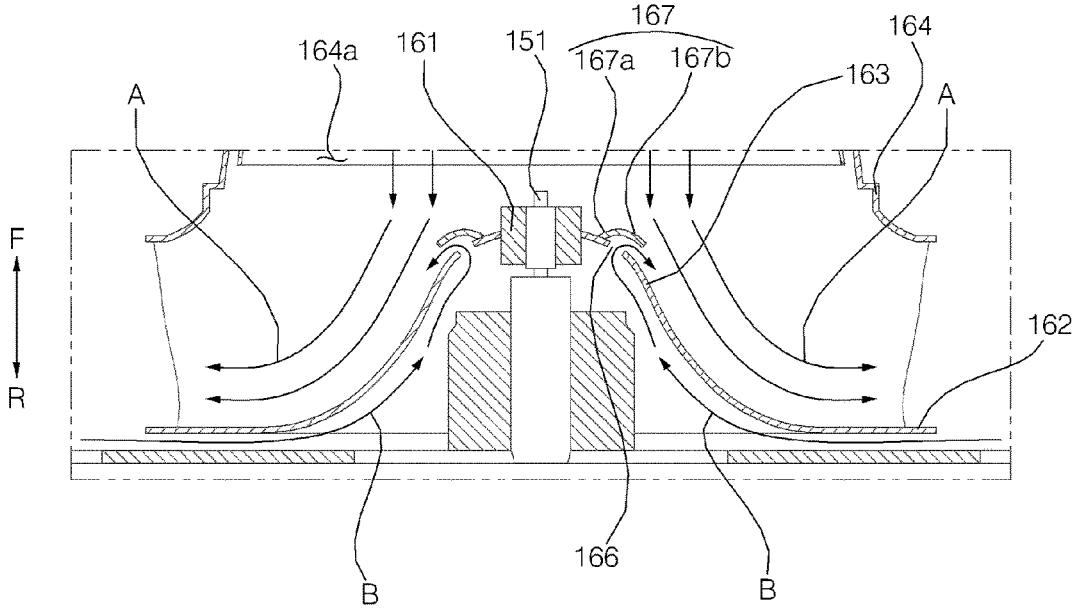
FIG. 7 is a sectional view of a centrifugal fan according to another embodiment as broadly described herein.

The changing device 167 may be connected to the rear facing side of the extending plate 163 as shown in FIG. 6, or may be connected to the front facing side of the extending plate 163 as shown in FIG. 7. Hereinafter, the case in which the changing device 167 is connected to the rear facing side of the extending plate 163 will be described.

The first end 167*a* of the changing device 167 may be connected to the extending plate 163 so that the direction of the motor heat dissipation flow B exhausted through the heat dissipation hole(s) 166 follows a path between the rear axial direction R and the radial direction, and the second end 167*b* of the changing device 167 is spaced apart from the extending plate 163. The changing device 167 covers at least the heat dissipation hole 166.

The area of the changing device 167 may be greater than that of the heat dissipation hole 166, and the second end 167*b* of the changing device 167 may be spaced apart from the extending plate 163. The motor heat dissipation flow B is not immediately exhausted through the heat dissipation hole 166 in the space in which the fan motor 15 is positioned, but follows a detour path.

The first end 167*a* of the changing device 167 may be coupled to the outer circumference of the extending plate 163, and the second end 167*b* of the changing device 167 may be formed in the central direction of the hub 161. The positions of the first end 167*a* and the second end 167*b* of the changing device 167 may be relative to each other. The first end 167*a* of the changing device 167 may be disposed adjacent to the heat dissipation hole 166.

Thus, the motor heat dissipation flow B is not immediately exhausted through the heat dissipation hole 166 in the space in which the fan motor 15 is positioned, but exhausted through the heat dissipation hole 166 via a detour established by the changing device 167. As a result, the direction of the motor heat dissipation flow B exhausted through the heat dissipation hole 166 may be changed.

Air resistance may be generated in the motor heat dissipation flow B by the changing device 167. Therefore, in order to minimize air resistance, the slope or curvature of the second end 167*b* of the changing portion 167 may be substantially equal to/the same as that of the extending plate 163. Here, equality may include error in terms of technology.

The changing device 167 may have various shapes. For example, the changing device 167 may have a ring shape formed about the rotary shaft 151 of the fan motor 15. That is, the changing device 167 may be formed in a ring shape which has a first end 167*a* coupled to the extending plate 163 adjacent to the heat dissipation hole 166 and a second end 167*b* spaced apart from the extending plate 163.

As another example, multiple changing devices 167 may be formed in a number corresponding to a number of heat dissipation holes 166. That is, the area of the changing device 167 may be greater than that of the heat dissipation hole 166, and the changing device 167 may be disposed in plural numbers corresponding to the respective heat dissipation holes 166. The first end 167*a* of the changing device 167 may be coupled to the extending plate 163 adjacent to the heat dissipation hole 166, and the second end 167*b* of the changing device 167 may be spaced apart from the extending plate 163.

FIG. 7 is a sectional view of a centrifugal fan according to another embodiment. Referring to FIGS. 5 and 7, the centrifugal fan 16 of the embodiment shown in FIG. 7 is different from the embodiment shown in FIG. 6 in the position of the changing device 167. Hereinafter, further detailed description of components the same as or similar to those of the embodiment shown in FIG. 6 will be omitted.

The changing device 167 may be connected to the front facing side of the extending plate 163. The first end 167*a* of the changing device 167 may be positioned adjacent to the outer circumference of the hub 161, and the second end 167*b* of the changing device 167 may be formed in the circumferential direction of the extending plate 163. The positions of the first end 167*a* and the second end 167*b* of the changing device 167 may be relative to each other, with the first end 167*a* of the changing device 167 disposed adjacent to the heat dissipation hole 166.

Thus, the motor heat dissipation flow B passing through the heat dissipation hole 166 is detoured by the changing device 167 so that the direction of the motor heat dissipation flow B is changed from the rear axial direction R to the radial direction. Air resistance may be generated in the motor heat dissipation flow B by the changing device 167. Therefore, the slope or contour of the second end 167*b* of the changing device 167 may be formed equal to or corresponding to that of the extending plate 163. Here, equality may include error in terms of technology.

Figure 8:
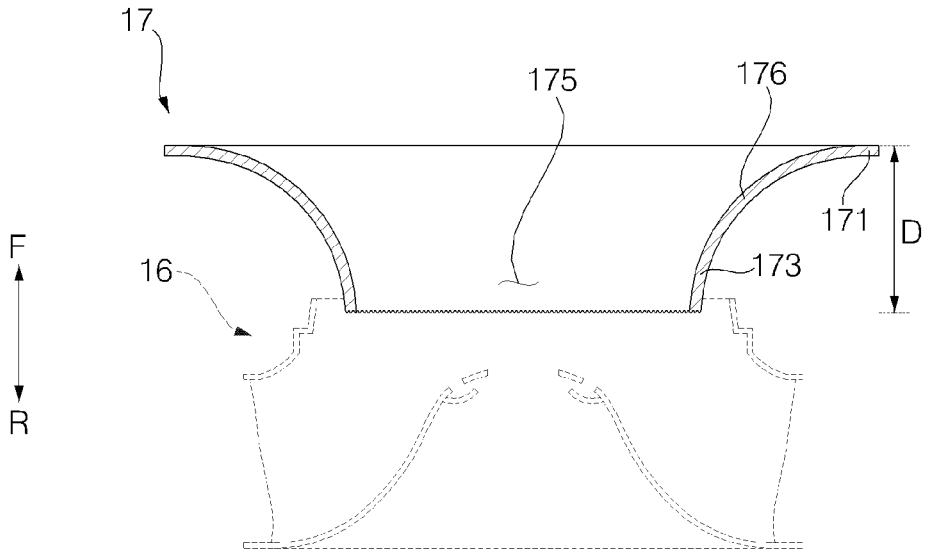
FIG. 8 is a sectional view of the bell mouth shown in FIG. 5.
Figure 9:
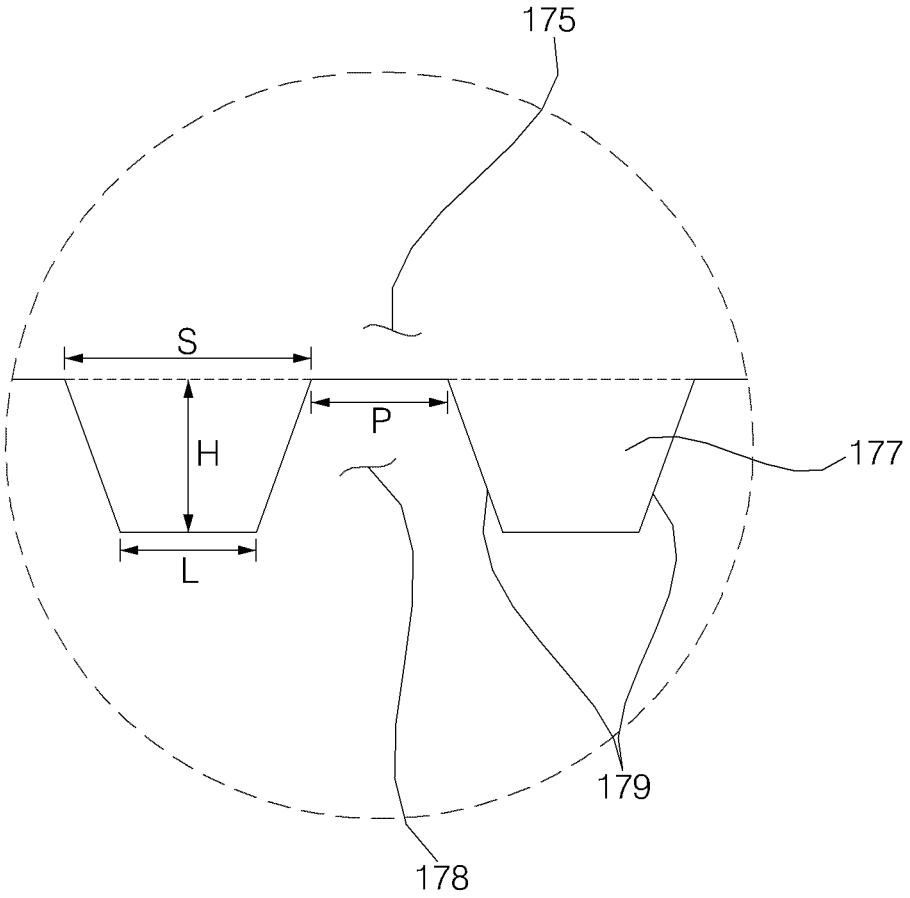
FIG. 9 is an enlarged view of a section A of the bell mouth shown in FIG. 5.

FIG. 8 is a sectional view of the bell mouth, according to an embodiment, and FIG. 9 is an enlarged view of portion A of the bell mouth shown in FIG. 5.

Referring to FIGS. 5, 8 and 9, the bell mouth 17 may be positioned to vertically overlap the centrifugal fan 16. The bell mouth 17 may have a shape and size corresponding to the air inlet 205 of the inlet/outlet panel assembly 100. The bell mouth 17 may guide air through the air inlet 205 in the direction of the suction opening 164*a* of the centrifugal fan 16. That is, the bell mouth 17 may serve as an orifice that controls the flow rate and flow speed of air by concentrating the indoor air at the rotary shaft of the blower 12.

The bell mouth 17 may be disposed opposite the shroud 164 at the front axial direction F with respect to the shroud 164. The bell mouth 17 may be formed so that a rear portion 173 of the bell mouth 17 is inserted into the shroud 164 through the suction opening 164*a*, with the rear portion 173 forming a predetermined gap with the suction opening 164*a* in the radial direction. That is, as shown in FIG. 8, the portion of the rear portion 173 of the bell mouth 17 may be inserted into the suction opening 164*a*.

For example, an opening 175 may be formed about the rotary shaft 151 of the fan motor 15 inside the bell mouth 17, and external air may be directed to the centrifugal fan 16 through the opening 175. That is, the opening 175 may have a circular shape corresponding to the suction opening 164*a* of the centrifugal fan 16 about the rotary shaft 151 of the fan motor 15. The opening 175 may overlap the suction opening 164*a* of the centrifugal fan 16 in the axial direction.

More specifically, the bell mouth 17 may have a ring shape having the opening 175 formed therein, and may be divided into a front portion 171 positioned at the front axial end F and a rear portion 173 positioned at the rear axial end R.

Based on FIG. 8, the bell mouth 17 may have a curved shape in which an external diameter of the opening 175 decreases as the opening 175 progresses from the front portion 171 to the rear portion 173. The front portion 171 may have a flange to be fixed to another structure. Since the external diameter of the rear portion 173 is smaller than that of the suction opening 164*a* of the centrifugal fan 16, the rear portion 173 of the bell mouth 17 may be inserted into the suction opening 164*a*.

An air guide surface 176 formed in a curved shape may be formed along the periphery of the opening 175. The air guide surface 176 may have a curved shape in which the external diameter of the opening 175 decreases as the opening 175 progresses from the front axial end F to the rear axial end R of the bell mouth 17. In this case, the outer circumferential portion of the bell mouth 17 may be formed corresponding to the opening 175 as shown in FIG. 8. However, the outer circumferential portion of the bell mouth 17 may be formed with another contour, not corresponding to the opening 175.

In order to efficiently suction external air, the bell mouth 17 and the centrifugal fan 16 may share the same central axis, and the central axis may be the rotary shaft of the fan motor 15. That is, the bell mouth 17 and the centrifugal fan 16 may be concentrically formed about the fan motor 15, and may vertically (axially) overlap each other.

A plurality of protruding portions 177 may be formed along the rear end of the rear portion 173, and a plurality of recessed portions 178 may be formed between the protruding portions 177. The protruding portions 177 and the recessed portions 178 may reduce noise in a high-frequency region, caused by turbulence generated between the shroud 164 of the centrifugal fan 16 and the rear portion 173 of the bell mouth 17.

Each protruding portion 177 may extend in the rear axial direction R relative to adjacent recessed portions 178, and each recessed portion 178 may be recessed in the front axial direction F relative to adjacent protruding portions 177. The protruding portions 177 and the recessed portions 178 may be alternately arranged and form a ring shape along the rear portion 173 of the bell mouth 17.

The protruding portion 177 and the recessed portion 178 may have various shapes. For example, a shape of the protruding portion 177 may be any one of a triangle, a quadrangle, a circle and the like, and a shape of the recessed portion 178 may be any one of a triangle, a quadrangle, a circle and the like. However, embodiments are not limited thereto.

In certain embodiments, the shapes of the protruding portion 177 and the recessed portion 178 may be symmetric to each other. However, the shapes of the protruding portion 177 and the recessed portion 178 may be asymmetric.

Specifically, as shown in FIG. 9, in an exemplary embodiment, each protruding portion 177 may include two sloped surfaces 179 inclined in the axial direction, and the width, or distance, between the sloped surfaces 179 may be narrowed as the sloped surfaces 179 progress from the front axial end F to the rear axial end R. That is, the protruding portion 177 may be formed in the shape of a trapezoid or a triangle.

The end of the bell mouth 17 including protruding portions 177 and the recessed portions 178 may be inserted into the shroud 164. That is, if the rear portion 173 of the bell mouth 17 is inserted relatively deep into the shroud 164, inflow may be decreased by the centrifugal fan 16. If the rear portion 173 of the bell mouth 17 is not inserted into the shroud 164, the air flowing in the centrifugal fan 16 may be exhausted, and therefore, the pressure and amount of air may be decreased. Thus, if at least the protruding portions 177 and the recessed portions 178 at the rear portion 173 of the bell mouth 17 are inserted into the shroud 164, it may be possible to prevent the pressure and amount of the air from being decreased. More specifically, the bell mouth 17 may be inserted into the shroud 164 with a depth two to four times greater than the average height of the protruding portions 177.

Hereinafter, it is assumed that the protruding portions 177 and the recessed portions 178 have shapes symmetric to each other, and the plurality of protruding portions 177 are spaced apart from one another at the same distance P.

For example, the height D of the bell mouth 17 and the height H of the protruding portion 177 may satisfy the following Relational Expression 1.

$$0.01 \leq \frac{H}{D} \leq 0.015 \tag{1}$$

If the height H of the protruding portion 177 is extremely greater than the height D of the bell mouth 17, the suctioned air is exhausted to the space though the recessed portions 178 between the protruding portions 177, and therefore, the pressure and amount of the suctioned air are decreased. If the height H of the protruding portion 177 is extremely smaller than the height D of the bell mouth 17, the noise in the high-frequency region is not reduced.

The height D of the bell mouth 17 and the width S of the protruding portion 177, that is, the width at the rear end of the protruding portion 177, may satisfy the following Relational Expression 2.

$$0.02 \leq \frac{S}{D} \leq 0.04 \tag{2}$$

If the width S of the rear end of the protruding portion 177 is extremely greater than the height D of the bell mouth 17, the number of protruding portions 177 and recessed portions 178, formed at the end of the rear portion 173 of the bell mouth 17, is remarkably decreased, and therefore, the noise in the high-frequency region is not reduced. If the width S of the rear end of the protruding portion 177 is extremely smaller than the height D of the bell mouth 17, the number of protruding portions 177 and recessed portions 178, formed at the end of the rear portion 173 of the bell mouth 177, is remarkably increased, and therefore, the end of the rear portion 173 of the bell mouth 17 is almost formed in the shape of a straight line. Accordingly, the noise in the high-frequency region is not reduced.

The width S of the rear end of the protruding portion 177 and width L a front end of the protruding portion 177 may satisfy the following Relational Expression 3.

$$0 \leq \frac{L}{S} \leq 1 \tag{3}$$

That is, the protruding portion 177 may be, at the extreme, formed in the shape of a triangle or a rectangle, but most fall within the shape of a trapezoid.

In certain embodiments, the spacing distance P between adjacent protruding portions 177 may be equal to the length S of the rear end of the protruding portion 177.

Figure 10A:
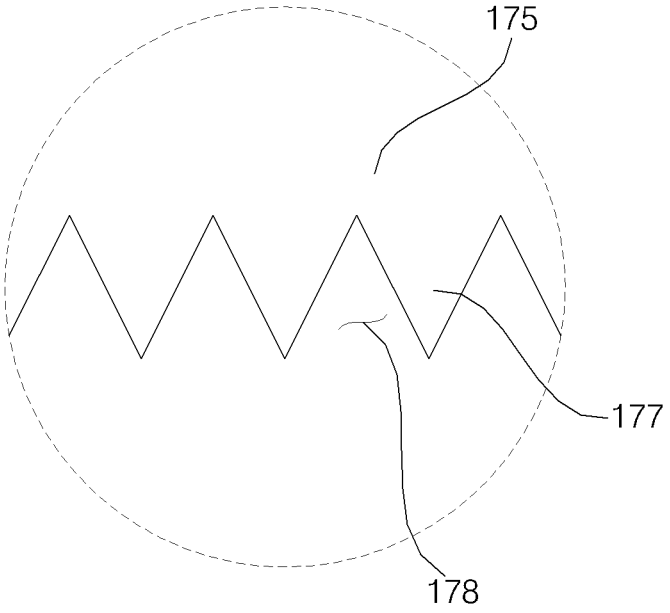
FIGS. 10A-10C are enlarged views of protruding portions and recessed portions of a bell mouth, in accordance with other embodiments as broadly described herein.
Figure 10B:
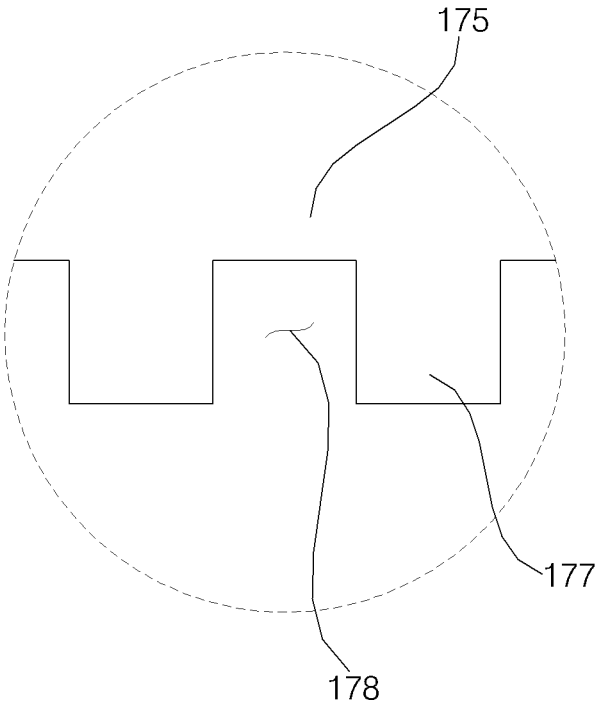
Figure 10C:
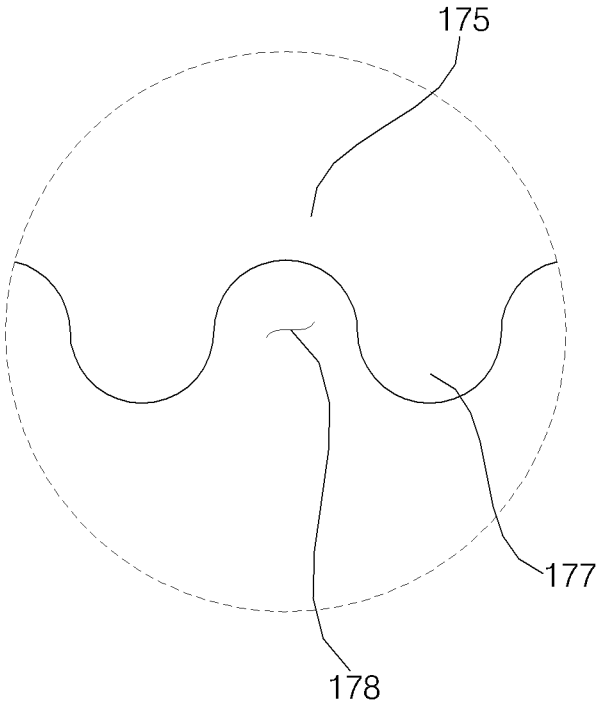

Various exemplary shapes and arrangements of the protruding portions 177 and the recessed portions 178 of the bell mouth 17 are shown in FIGS. 10A-10C. For example, the protruding portion 177 may be formed in the shape of a triangle, a quadrangle or a semi-circle, and the recessed portion 178 may have a shape symmetric to the protruding portion 177. However, embodiments are not limited thereto.

Figure 3:
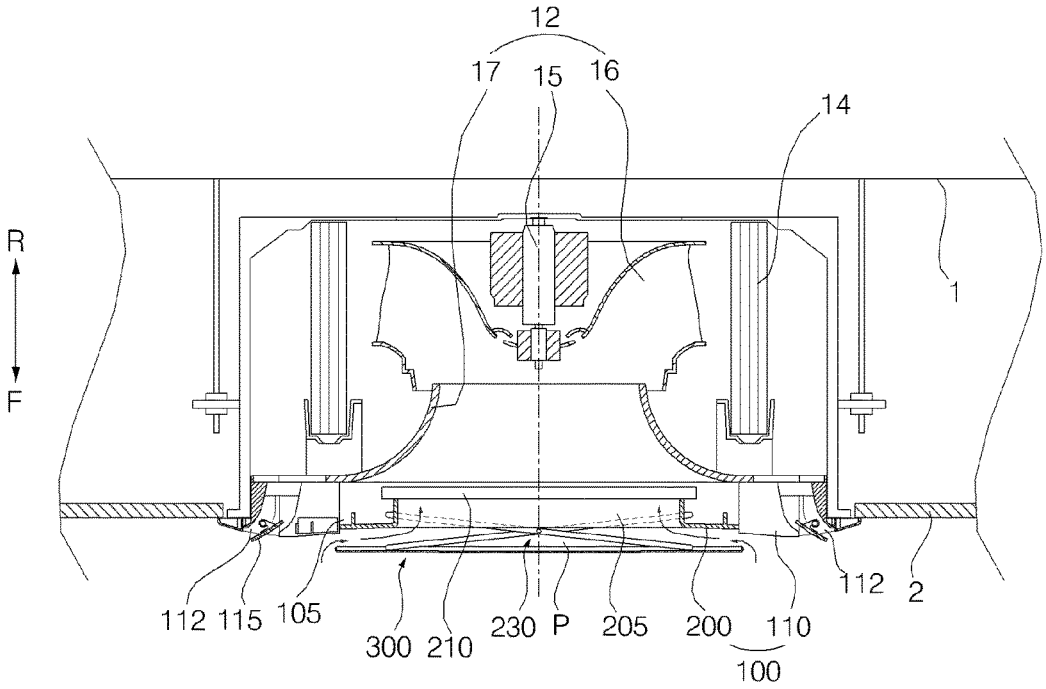
FIG. 3 is a sectional view of the air conditioner shown in FIGS. 1 and 2 during operation.
Figure 4:
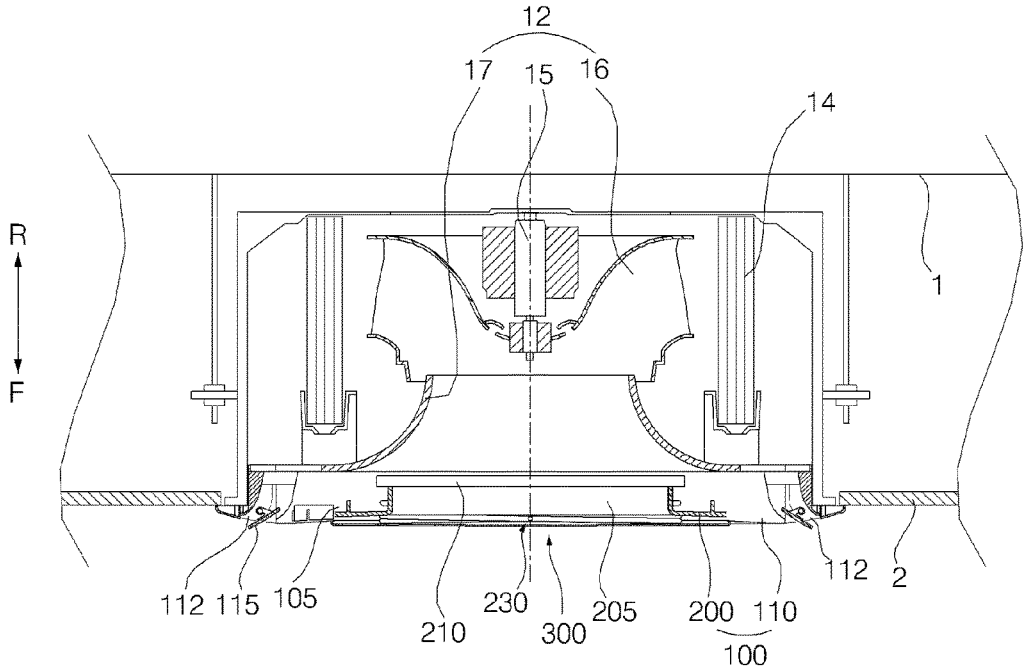
FIG. 4 is a sectional view of the air conditioner shown in FIGS. 1 and 2 with operation stopped.
Figure 11:
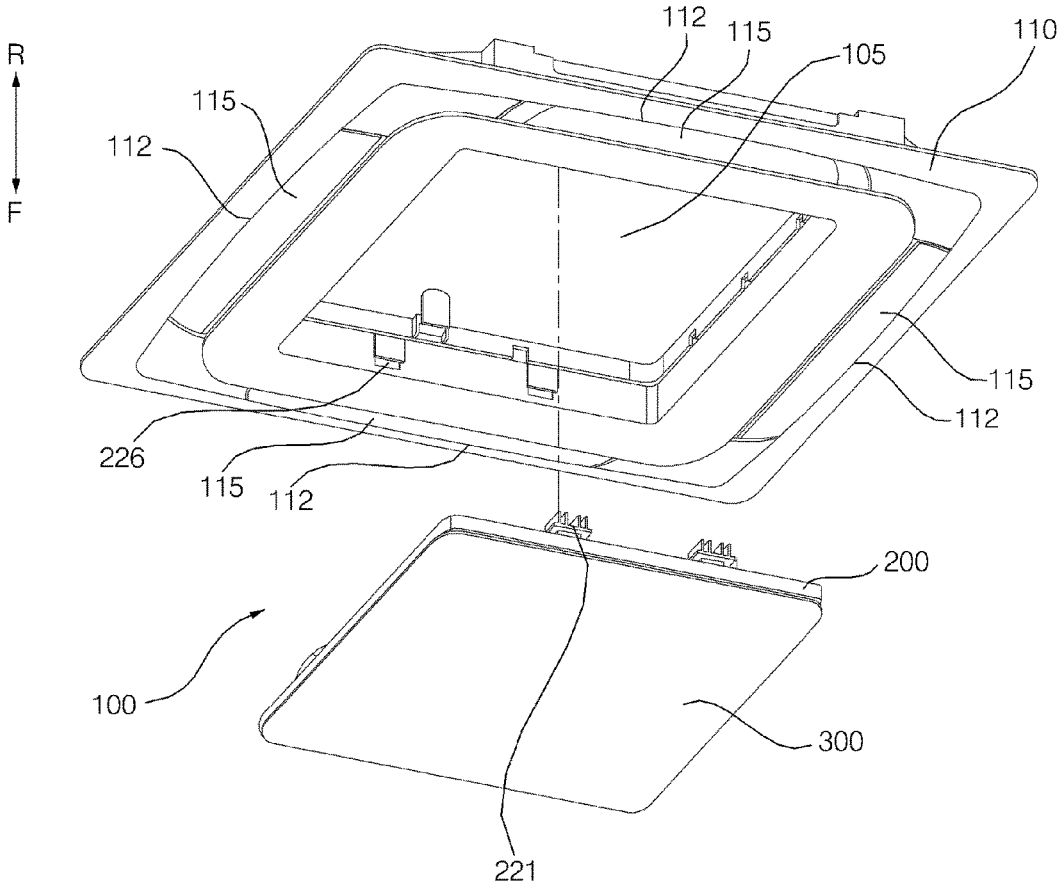
FIG. 11 is a perspective view of a state in which an inlet/outlet panel assembly shown in FIGS. 3 and 4 is separated.

FIG. 11 is a perspective view of the inlet/outlet panel assembly shown in FIGS. 3 and 4, in a separated state.

Referring to FIG. 11, an opening 105 may be formed at a central portion of the outlet panel 110 in which the inlet panel 200 is disposed, and the air outlets 112 may be respectively formed at the front, rear, left and right around the opening 105, spaced apart from one another. In certain embodiments, the air outlets 112 may be spaced apart from the opening 105.

The inlet panel 200 may be attached to/detached from the outlet panel 110 so as to be movably positioned inside the opening 105.

The air inlet 205 is formed at a position corresponding to the central portion of the inlet panel 200. A purification filter mounting portion 215 (see FIG. 12) may be provided at the air inlet 205 so that the purification device 210 may be mounted by, for example, a hook. That is, in certain embodiments, the inlet panel 200 may serve as a case for the purification device 210 and provide an installation space in which the purification device 210 is received.

The inlet panel 200 may be configured so that the air inlet 205 is formed in a circular shape, or may be configured so that the air inlet 205 is formed in a square shape or another shape.

In a case in which the air inlet 205 is formed in a circular shape, the inlet panel 200 may serve as an orifice that controls the flow rate and flow speed of air by concentrating the suctioned indoor air at a central portion thereof. In a case in which the air inlet 205 is formed in a quadrangular shape, greater than the circular shape, it may be possible to quickly suction the air.

In other words, the air inlet 205 may be formed in the inlet/outlet panel assembly 100. In a case in which the inlet/outlet panel assembly 100 includes the inlet panel 200 and the outlet panel 110, the air inlet 205 may be formed by coupling the inlet panel 200 and the outlet panel 110. In an alternative embodiment, the air inlet 205 may be formed by forming an opening at the center of the inlet/outlet panel assembly 100.

Figure 12:
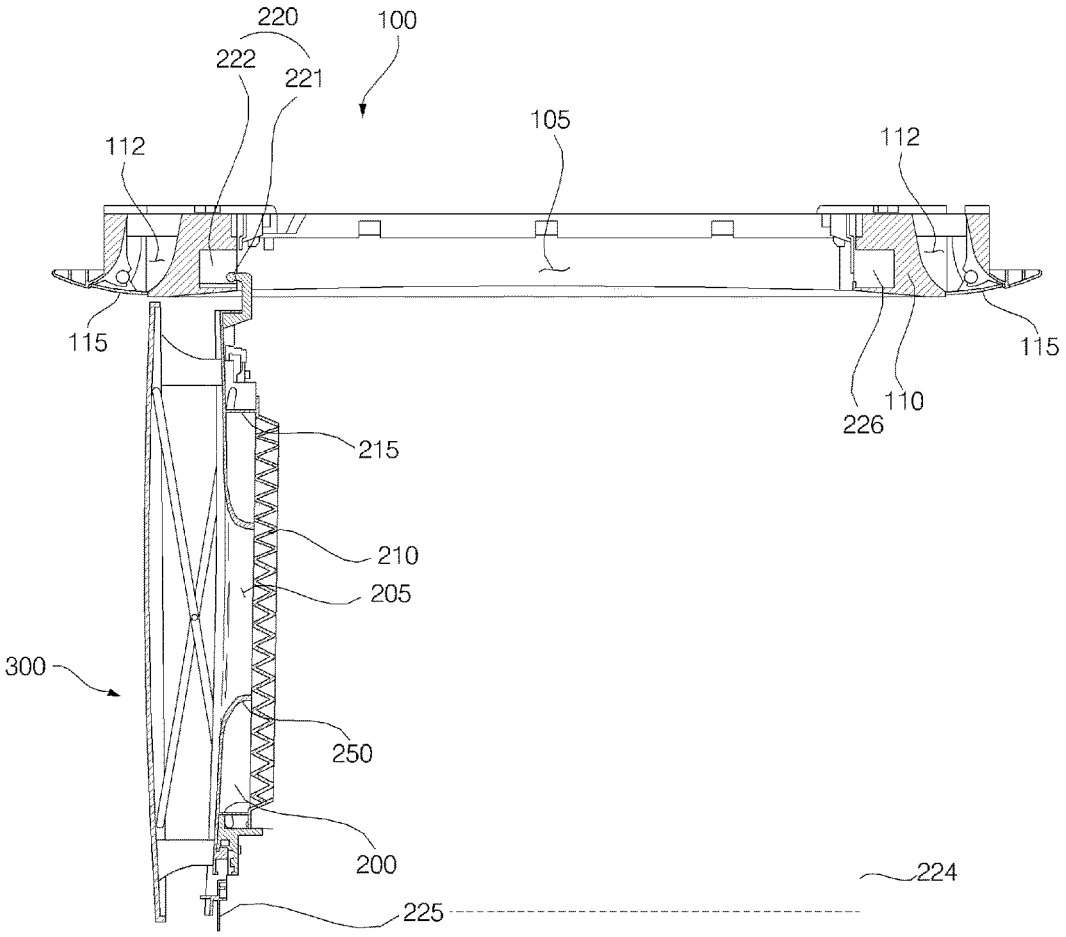
FIG. 12 is a sectional view of a state in which inlet and door panels shown in FIGS. 3 and 4 are rotated together.

FIG. 12 is a sectional view of a state in which the inlet panel 200 and door panel 300 shown in FIGS. 3 and 4 are rotated together, away from the outlet panel 110, to open the opening 105, so that an interior of the main body 10 may be accessed for service of the various components, and the purification device 210 may be accessed and serviced.

One end of the inlet panel 200 may be connected to one side of the opening 105 by a hinge 220, and the other end of the inlet panel 200 may be attached to/detached from the other side of the opening 105 by an attaching/detaching device 224 including a slider 225 and a latch 226.

The hinge 220 may include a hinge shaft 221 formed on one of the outlet panel 110 or the inlet panel 200, and a hinge shaft support 222 formed in the other of the outlet panel 110 or the inlet panel 200. The attaching/detaching device 224 may include the slider 225 slidably provided on one of the outlet panel 110 or the inlet panel 200, and the slider latch 226 formed so that the slider 225 is inserted into and latched to the other of the outlet panel 110 or the inlet panel 200. If the latching of the slider 225 to the slider latch 226 is released by moving the slider 225, and the hinge shaft 221 is then rotated downward, the hinge shaft 221 latched to the hinge shaft support 222, the inlet panel 200 is rotated downward together with the door panel 300 and the purification device 210, as shown in FIG. 12. In this case, the inlet panel 200 and the door panel 300 may be disposed vertically so that the opening 105 is opened. If the inlet panel 200 is rotated upward, with the hinge shaft 221 latched to the hinge shaft support 222, and the slider 225 is then inserted into the slider latch 226, the inlet panel 200 and the door panel 300 shield the opening 105.

That is, in a case in which the inside of the main body 10 is to be serviced, the inlet panel 200 may rotate together with the door panel 300, about the hinge 220 to open the opening 105, and thus a worker may conveniently service the inside of the main body 10 without separating/disassembling the outlet panel 110. In a case in which the purification device 210 or the ascending/descending mechanism 230 is to be serviced, the inlet panel 200 may be separated, together with the door panel 300, from the outlet panel 110, and thus the worker may conveniently service the purification device 210 or the ascending/descending mechanism 230 without separating/disassembling the outlet panel 110.

Figure 13:
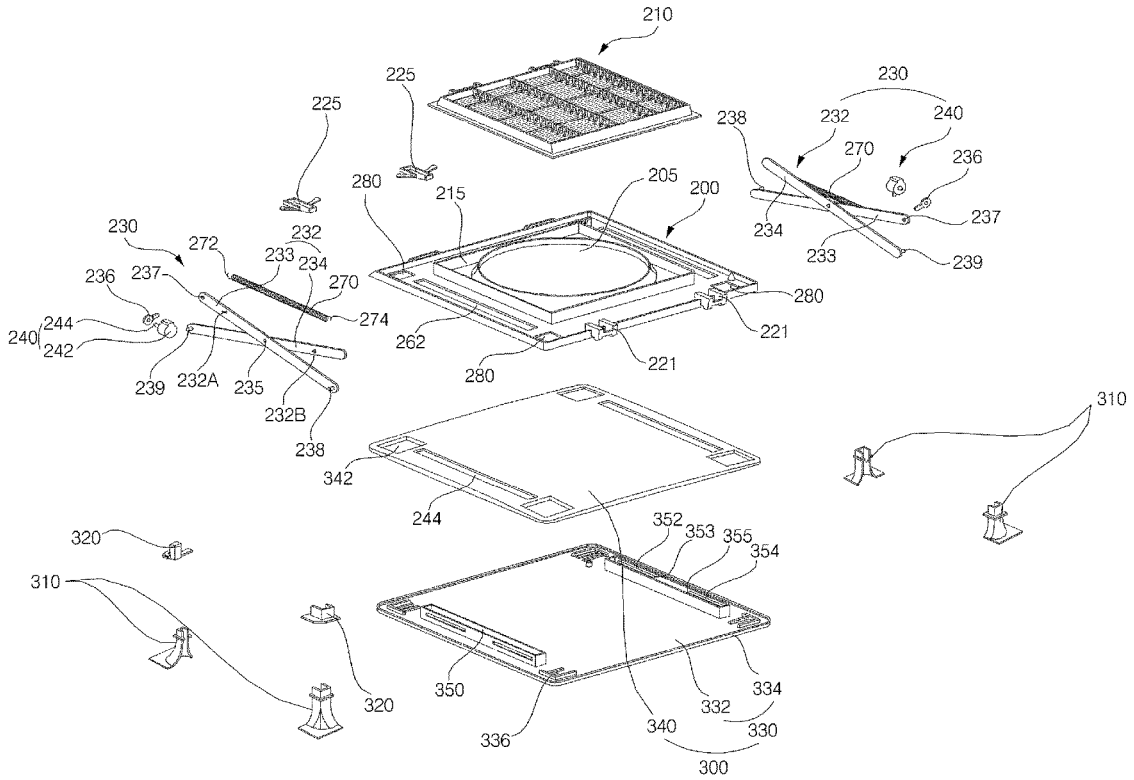
FIG. 13 is an exploded perspective view of the inlet and door panels shown in FIGS. 3 and 4.
Figure 14:
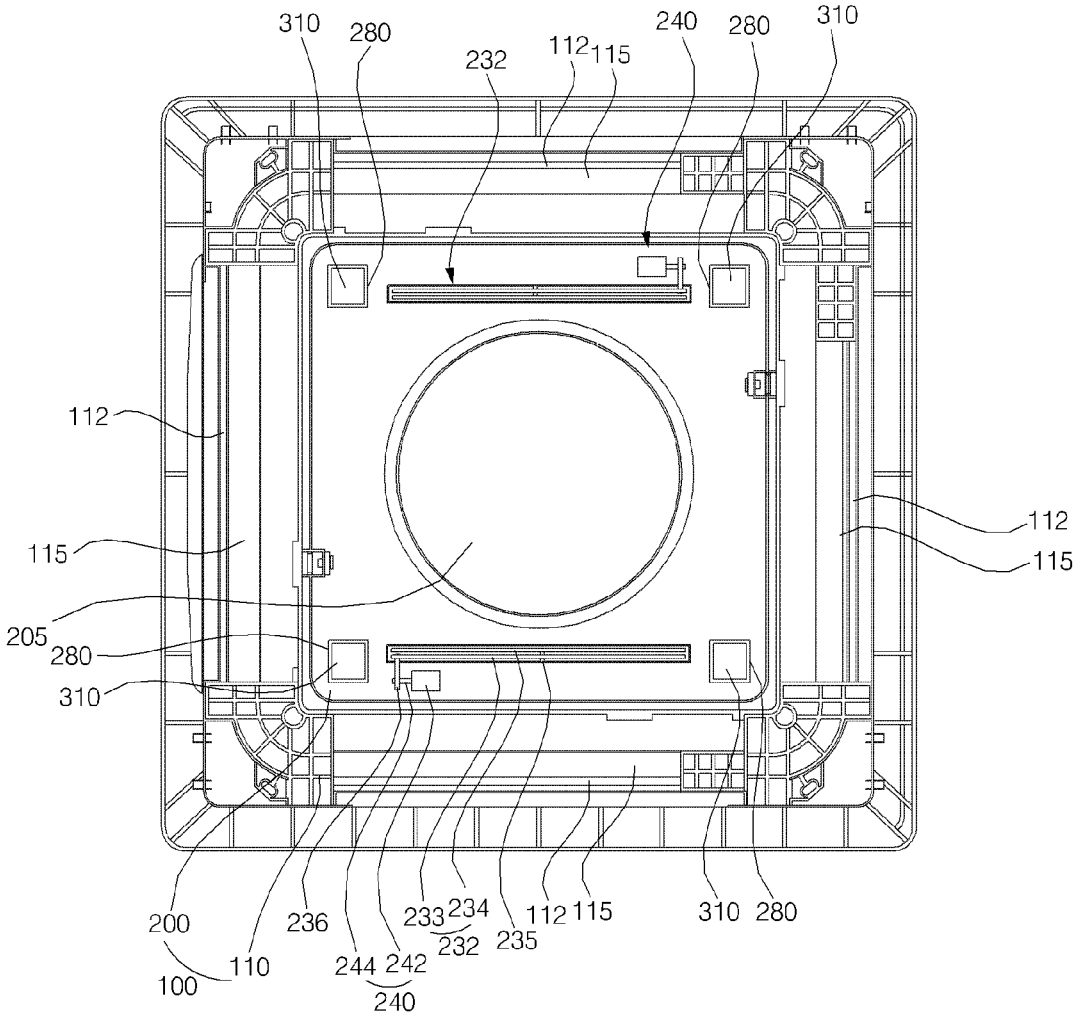
FIG. 14 is a plan view of the inlet/outlet panel assembly shown in FIGS. 3 and 4.
Figure 15:
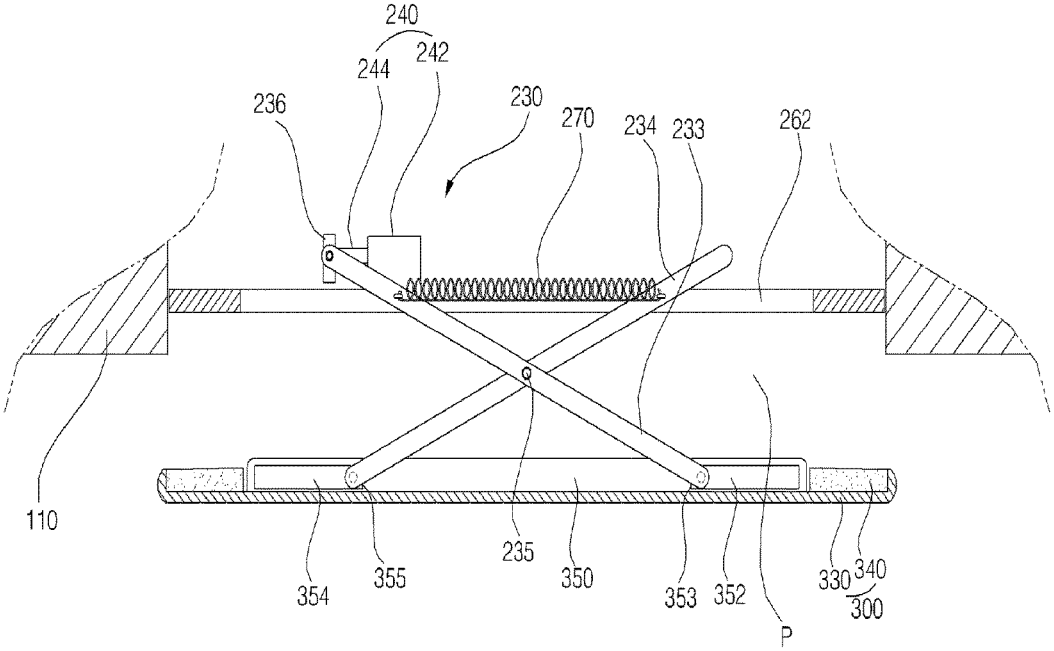
FIG. 15 is an enlarged side view of the door panel shown in FIGS. 3 and 4 in a descended state.
Figure 16:
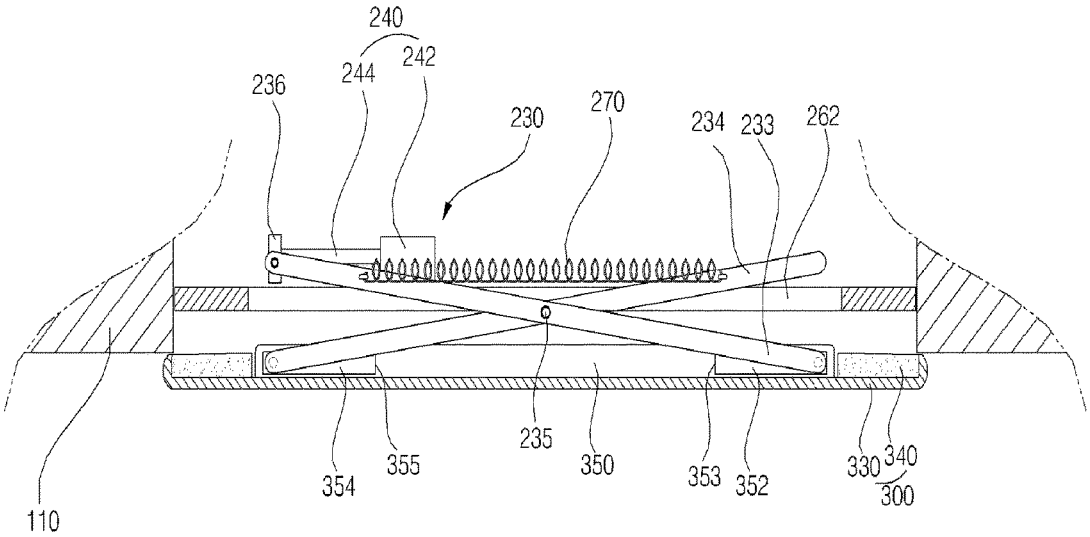
FIG. 16 is an enlarged side view of the door panel shown in FIGS. 3 and 4 in an ascended state.

FIG. 13 is an exploded perspective view of the inlet and door panels shown in FIGS. 3 and 4. FIG. 14 is a plan view of the inlet/outlet panel assembly shown in FIGS. 3 and 4. FIG. 15 is an enlarged side view showing the door panel in a descended state. FIG. 16 is an enlarged side view showing the door panel in an ascended state.

The door panel 300 may be descended, or lowered, to allow the air inlet 205 to communicate with the outside, or may be ascended, or raised, to shield the air inlet 205. The ascending/descending of the door panel 300 may be performed by the ascending/descending mechanism 230. The ascending/descending mechanism 230 may include an X-link 232 having a lower portion connected to the door panel 300, and an X-link diffraction mechanism 240 mounted to the inlet panel 200.

In certain embodiments, a plurality of pairs of the X-link 232 and the X-link diffraction mechanism 240 may be symmetrically installed, spaced apart, at the front and rear or the left and right of the inlet panel 200.

The X-link diffraction mechanism 240 may be mounted to the inlet panel 200 so as to lower the door panel 300 by pushing the door panel 300 downward and to raise the door panel 300 by pulling the door panel 300 upward. Alternately, the X-link diffraction mechanism 240 may be positioned at the side of the door panel 300 so as to lower the door panel 300 in response to the X-link 232 pushing the inlet panel 200, and to raise the door panel 300 in response to the X-link 232 pulling the inlet panel 200. Hereinafter, the example in which the X-link diffraction mechanism 240 is mounted on the inlet panel 200 will be described in this embodiment.

The ascending/descending mechanism 230 may be configured so that one X-link diffraction mechanism 240 rotates one X-link 232, or may be configured so that one X-link diffraction mechanism 240 rotates a plurality of X-links 232.

In a case in which the X-link diffraction mechanism 240 is mounted on the inlet panel 200, the X-link diffraction mechanism 240 is not visible and is covered by the inlet panel 200. In certain embodiments, a link through-portion through which the X-link 232 passes may be formed in the inlet panel 200. In a case in which where the X-link diffraction mechanism 240 is hung on the inlet panel 200, the link through-portion through which the X-link 232 passes is not necessarily formed in the inlet panel 200. However, the X-link diffraction mechanism 240 may be visible from the outside through the air suction flow path P and interfere with the smooth suction of air. Hereinafter, the case in which the X-link diffraction mechanism 240 is mounted on the inlet panel 200 will be described.

A link through-portion 262, or link through hole 262, may be formed as a hole or slot in the inlet panel 200, through which the X-link 232 may pass to be connected to the door panel 300. The X-link 232 may include a first link 233 and a second link 234 rotatably connected to the first link 233. Each of the first and second links 233 and 234 may have an upper end positioned above the inlet panel 200 and a lower end positioned on an upper surface of the door panel 300. The first and second links 233 and 234 may pass through the link through-portion 262. The first and second links 233 and 234 may be connected so that their central portions are rotated about a hinge shaft 235.

The X-link diffraction mechanism 240 may be connected to upper portions of both the first and second links 233 and 234 and the driving force of the X-link diffraction mechanism 240 may be transmitted to both the first and second links 233 and 234. Alternatively, the X-link diffraction mechanism 240 may be connected to the upper portion of only one of the first or second link 233 and 234, with the other of the first or second link 233 and 234 forming a free end. In this case, the link that is connected to the X-link diffraction mechanism 240 may serve as a driving link, and the link not connected to the X-link diffraction mechanism 240 may serve as a driven link. That is, the X-link diffraction mechanism 240 may be connected to at least one of the first link 233 or to the second link 234 of the X-link 232 to provide for diffraction, or spreading of the X-link 232.

The X-link diffraction mechanism 240 may be configured as a rectilinear movement mechanism that allows the upper portion of at least one of the first or second link 233 and 234 of the X-link 232 to be rectilinearly moved. Alternatively, the X-link diffraction mechanism 240 may be configured as a rotary mechanism that allows the upper portion of at least one of the first or second link 233 and 234 of the X-link 232 to be rotated. Hereinafter, the rectilinear movement mechanism will be described as an example.

The X-link diffraction mechanism 240 may be configured as an actuator or linear motor that allows the upper portion of at least one of the first or second link 233 and 234 of the X-link 232 to be rectilinearly moved. Hereinafter, the actuator will be described as an example.

In a case in which the X-link diffraction mechanism 240 includes a first actuator allowing the upper portion of the first link 233 to be rectilinearly moved and a second actuator allowing the upper portion of the second link 234 to be rectilinearly moved, the first and second actuators may horizontally move the upper ends of the first and second links 233 and 234 so that the upper portions of the first and second links 233 and 234 are moved closer to each other, thereby unfolding or expanding the X-link 232. The first and second actuators may horizontally move the first and second links 233 and 234 so that the upper portions of the first and second links 233 and 234 move apart from each other, thereby folding or retracting the X-link 232.

In a case in which the X-link diffraction mechanism 240 includes one actuator connected to the upper portion of one of the first or second link 233 and 234, the one actuator horizontally moves the one of the first or second link 233 and 234 so that the upper portion of the one of the first or second link 233 and 234 is close to that of the other link, thereby unfolding or expanding the X-link 232. The one actuator may also horizontally move the one of the first or second link 233 and 234 so that the upper portion of the one of the first or second link 233 and 234 is distant from that of the other link, thereby folding or retracting the X-link 232.

Hereinafter, an embodiment in which the X-link diffraction mechanism 240 includes one actuator will be described.

The X-link diffraction mechanism 240 may include a driver 242 and a rod 244 connected to the driver 242 so as to move forward/backward. The rod 244 may be rotatably connected to one of the first link 233 or the second link 234.

A hinge shaft 236 may be provided at one of the rod 244 and one of the first or second link 233 and 234, and a connection portion 231 of the rotary shaft 151, rotatably connected to the hinge shaft 236, may be provided at the other of the rod 244 and one of the first or second links 233 and 234.

The ascending/descending mechanism 230 may also include a spring 270 connecting the first and second links 233 and 234. The spring 270 may apply a restoration force in the direction where the spring 270 is unfolded when the X-link 232 is folded. Alternatively, the spring 270 may apply a restoration force in the direction where the spring 270 is folded when the X-link 232 is unfolded.

The spring 270 may be installed so that the restoration force is applied in the direction where the X-link 232 is unfolded when the descending speed of the door panel 300 is faster than the ascending speed of the door panel 300. On the contrary, the spring 270 may be installed so that the restoration force is applied in the direction where the X-link 232 is folded when the ascending speed of the door panel 300 is faster than the descending speed of the door panel 300. In certain embodiments, the door panel 300 may require a larger force when being raised rather than when being lowered, and therefore, the spring 270 may be installed so that the restoration force is applied in the direction where the X-link 232 is folded.

The spring 270 may be, for example, a coil-type spring which has one end connected to the first link 233 and the other end connected to the second link 234, with a connection portion 272 formed at the one end of the spring 270, and a connection portion 274 formed at the other end of the spring 270. A fixing portion 232A to which the connection portion 272 of the spring 270 is latched and fixed may be formed in a ring shape in the first link 233, and a fixing portion 232B to which the connection portion 274 of the spring 270 is latched and fixed may be formed in a ring shape in the second link 234.

The air conditioner according to this embodiment may also include a guide device 310 guiding the ascending/descending, or raising/lowering, of the door panel 300. A lower portion of the guide device 310 may be fastened to the door panel 300 by a latching device such as a hook, or by a fastener such as a screw. The guide device 310 may extend through a through hole 280 formed in the inlet panel 200 and may guide the door panel 300 to the inlet panel 200 as the door panel 300 is raised.

The door panel 300 may be made as light as possible to decrease the power consumption of the ascending/descending mechanism 230, particularly by a motor. In certain embodiments, the door panel 300 may have a double structure including a lower panel 330 made of a relatively strong material to form the exterior an upper panel 340 lighter than the lower panel 330 so as to guide the indoor air.

The lower panel 330 may be transparent when viewed from the interior of a room, and may be made of a metal or glass material. Alternatively, the lower panel 330 may be made of a plastic molded material lighter than that metal or glass material.

The upper panel 340 may form an air guide which guides air drawn in through the air inlet 205. The upper panel 340 may be made of a foamed plastic lighter than a general plastic. The upper surface of the upper panel 340 may have an upwardly convex shape to effectively guide the air.

In a case in which the lower panel 330 is configured as a plate body, and the upper panel 340 is positioned on the lower panel 330, the upper panel 340 may be partially visible from below the air conditioner. The lower panel 330 may form the external appearance of the circumference of the door panel 300.

The lower panel 330 may include a lower plate 332 and a quadrangular-strap-shaped rib 334 that protrudes upward along the edge of the lower plate 332, with the upper panel 340 positioned inside the rib 334.

Since the guide device 310 is fastened to the door panel 300, a guide fastening portion at which the guide device 310 is fastened to the door panel 300 may protrude from an upper surface of the lower plate 332 of the lower panel 336.

A guide device through hole 342 through which the guide device 310 passes may be formed in the upper panel 340 of the door panel 300.

The door panel 300 may include a sliding guide 350 to which the X-link 232 is slidingly connected. Protrusions 238 and 239 may be respectively formed at lower portions of the first and second links 233 and 234 of the X link 232. The sliding guide 350 may include guide rails 352 and 354 along which the respective protrusions 238 and 239 are slidingly guided. The guide rails 352 and 354 may extend longitudinally in the horizontal direction. The guide rails 352 and 354 may respectively include stoppers 353 and 355 blocking the X-link 232 from being excessively unfolded.

In certain embodiments, the sliding guide 350 may be formed on the lower panel 330. The upper panel 330 may include a link through hole or slot 244 through which the sliding guide 350 and the links 233 and 234 pass so that the first and second links 233 and 234 of the X-link 232 may be connected to the sliding guide 350.

Operation of an air conditioner configured as described above will be described as follows.

First, when the air conditioner is operated, the actuator 240 of the ascending/descending mechanism 230 may be driven in a door open mode, and the exhaust vane driving mechanism may be driven so that the exhaust vane(s) 115 open the air outlet(s) 112. The fan motor 15 of the blower 12 may also be driven.

If the actuator 240 of the ascending/descending mechanism 230 is driven in the door open mode, the actuator 240, as shown in FIG. 13, allows the upper portion of the link to which the rod 244 is connected to be rectilinearly moved, in a direction toward the upper portion of the other link of the X-link 232. The lower portions of the first and second links 233 and 234 move toward each other while being guided to the sliding guide 350 of the door panel 300. In this case, the interval between the upper portions of the first and second links 233 and 234 and the interval between the lower portions of the first and second links 233 and 234 are narrowed, thereby unfolding the X-link 232.

When the X-link 232 is unfolded as described above, the X-link 232 pushes the door panel 300 downward, and the door panel 300 is lowered by the force with which the X-link 232 pushes downward on the door panel 300 and the weight of the door panel 300 itself. In this case, the guide device 310 may stably descend while being guided to the inlet panel 200.

When the door panel 300 is descended, or lowered, as described above, the air suction flow path P is formed between the door panel 300 and the inlet panel 200. If the motor of the blower 12 is driven, the indoor air is drawn in between the door panel 300 and the inlet panel 200 through the air suction flow path P, and then moved upward through the air inlet 205 of the inlet panel 200. The air passing through the air inlet 205 may be purified by passing through the purification device 210 and then sucked into the blower 12. Subsequently, the air may undergo heat-exchange in the heat exchanger 14 and then be distributed and exhausted through the plurality of air outlets 112 into a designated space to be heated/cooled.

On the other hand, when the air conditioner is stopped, the actuator 240 of the ascending/descending mechanism 230 may be driven in a door close mode, and the exhaust vane driving mechanism may be driven so that the exhaust vane(s) 115 shield the air outlet(s) 112. The fan motor 15 of the blower 12 may also be stopped.

If the actuator 240 of the ascending/descending mechanism 230 is driven in the door close mode, the actuator 240 allows the upper portion of the link to which the rod 244 is connected to be rectilinearly moved in the opposite direction, away from the upper portion of the other link of the X-link 232. The lower portions of the first and second links 233 and 234 move away from each other while being guided by the sliding guide 350 of the door panel 300. In this case, the interval between the upper portions of the first and second links 233 and 234 and the interval between the lower portions of the first and second links 233 and 234 are moved apart, thereby folding the X-link 232.

When the X-link 232 is folded, the X-link 232 pulls the door panel 300 upward. The door panel 300 is raised while the guide device 310 is guided to the inlet panel 200 so that the air suction flow path P is gradually narrowed. The door panel 30 reaches the position at which the door panel 300 is maximally ascended, i.e., the position at which the gap between the inlet panel 200 and the door panel 300 is not visible from the outside.

When the door panel 300 is raised as described above, the spring 270 applies a restoration force in the direction where the spring 270 pushes the upper portions of the first and second links 233 and 234 in the X-link 232, thereby folding the X-link 232, i.e., helping the door panel 300 to ascend.

Thus, the power consumption of the actuator may be minimized, and the door panel 300 may be raised by a relatively low capacity actuator.

When the door panel 300 is raised, the door panel 300 may form the external appearance of the central lower surface of the air conditioner, and the outlet panel 110 may form the external appearance of an area surrounding the door panel 300.

Figure 17:
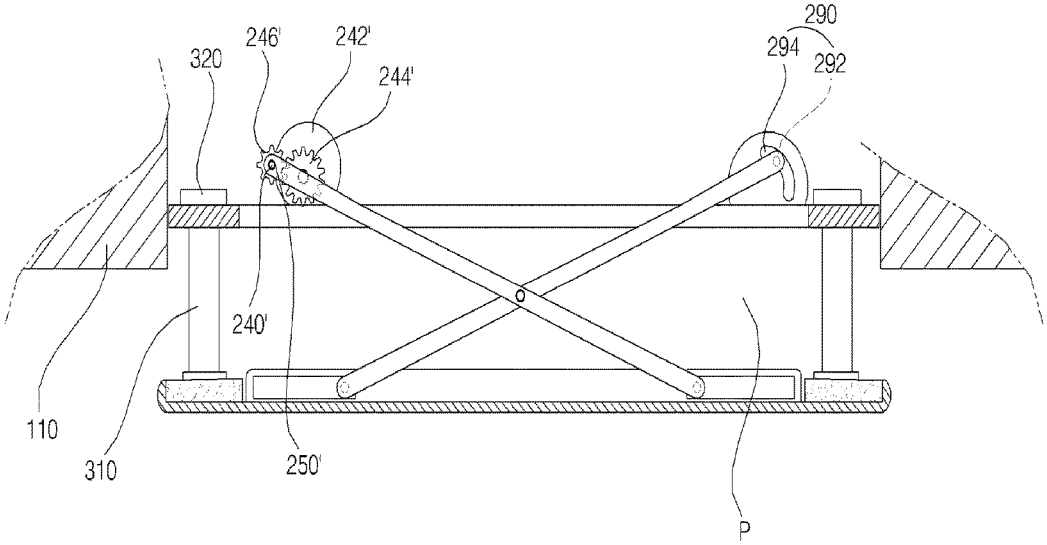
FIG. 17 is a sectional view of an air conditioner during operation.
Figure 18:
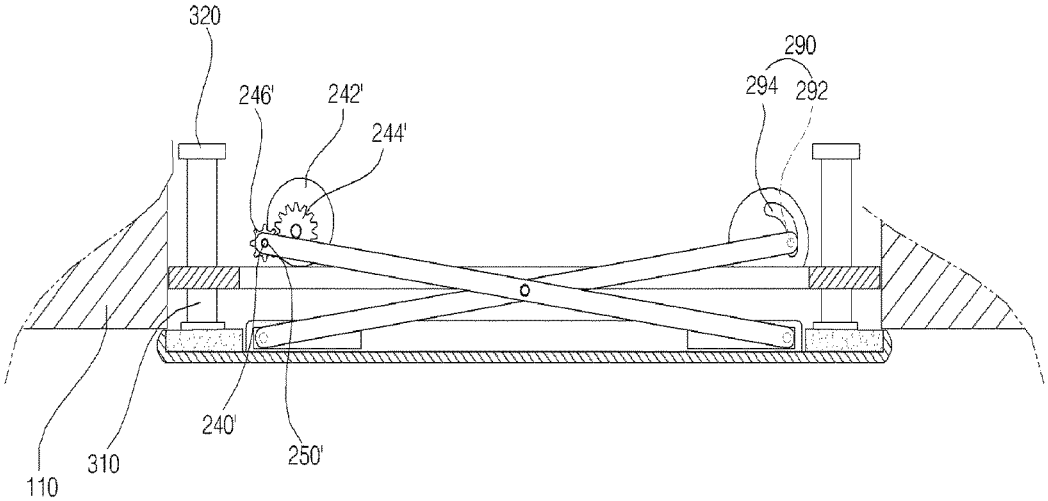
FIG. 18 is a sectional view of the air conditioner in a stopped state, in accordance with another embodiment as broadly described herein.

FIG. 17 is a sectional view of an air conditioner, during operation, according to another embodiment as broadly described herein, and FIG. 18 is a sectional view of the air conditioner, in an operation stopped state.

The air conditioner according to this embodiment, as shown in FIGS. 17 and 18, includes an X-link diffraction mechanism 240' mounted at the inlet panel 200, a motor 242' having the rotary shaft 151, a driving gear 244' mounted to the rotary shaft 151, and a driven gear 246' provided at at least one of the first or second link 233 and 234 and engaged with the driving gear 244'. Other components, except the X-link diffraction mechanism 240', the same as or similar to those of the aforementioned embodiment, are designated by like reference numerals, and their detailed descriptions will be omitted.

The X-link diffraction mechanism 240' may be a rotary mechanism that rotates the upper portion of one of the first or second link 233 and 234 of the X-link 232. Like the aforementioned embodiment, the X-link diffraction mechanism 240' may include a first rotary mechanism rotating the upper portion of the first link 233 and a second rotary mechanism rotating the upper portion of the second link 234. Alternatively, the X-link diffraction mechanism 240' may include one rotary mechanism connected to one of the first or second link 233 and 234. Hereinafter, the case in which the X-link diffraction mechanism 240' includes one rotary mechanism connected to one of the first link 233 or the second link 234 will be described.

The driven gear 246' may be rotatably connected to a side of one of the first link 233 or the second link 234. A hinge shaft 248' may be provided to the driven gear 246' and one of the first or second link 233 and 234. A connection portion 250' of the rotary shaft 151, to which the hinge shaft 248' is rotatably connected, may be provided to the other of the first or second link 233 and 234. The driven gear 246' may move in a circular track as it rotates along the outer surface of the driving gear 244' when the driving gear 244' is rotated. The driven gear 246' rotates the upper portion of the link to which the driven gear 246' is mounted.

The air conditioner according to this embodiment may also include a rotary guide 290 guiding the upper portion of one of the first or second link 233 and 234, to which the X-link diffraction mechanism 240' is not connected, and a stopper 320 limiting the descending height of the door panel 300. The rotary guide 290 may include a protrusion 292 formed on one of the link to which the X-link diffraction mechanism 240' is not connected or the inlet panel 200, and a guide rail 294 formed on the other of the link or the inlet panel 200 to allow for movement along a circular track. The stopper 320 may be positioned above the guide member 310 so as to be downwardly latched to the inlet panel 200 when the door panel 300 is maximally descended.

The operation of the air conditioner configured as described above will now be described.

First, when the air conditioner is operated, the motor 242' of the X-link diffraction mechanism 240' is driven in a door open mode, and the exhaust vane driving mechanism is driven so that the exhaust vane(s) 115 open the air outlet(s) 112. The fan motor 15 of the blower 12 is also driven. If the motor 242' of the X-link diffraction mechanism 240' is driven in the door open mode, the motor 242' rotates the driving gear 244' connected to the rotary shaft 151, and the driven gear 246' rotatably mounted to the X-link 232 is ascended along the circular track at the outside of the driving gear 244' while being rotated along the driving gear 244'. In this case, the horizontal interval between the upper portions of the first and second links 233 and 234 and the horizontal interval between the lower portions of the first and second links 233 and 234 are narrowed, thereby unfolding the X-link 232. When the X-link 232 is unfolded as described above, the X-link 232 pushes the door panel 300 downward, and the door panel 300 is descended in response to the force with which the X-link 232 pushes downward on the door panel 300 and the weight of the door panel 300 itself. In this case, the guide device 310 may be stably descended while being guided to the inlet panel 200.

When the door panel 300 is lowered as described above, the air suction flow path P may be formed between the door panel 300 and the inlet panel 200. If the motor of the blower 12 is driven, the indoor air may be drawn between the door panel 300 and the inlet panel 200 through the air suction flow path P, and then moved upward through the air inlet 205 of the inlet panel 200. The air passing through the air inlet 205 may be purified by passing through the purification device 210 and then sucked into the blower 12. Subsequently, the air may undergo heat-exchange in the heat exchanger 14 and then be distributed and exhausted indoors through the plurality of air outlets 112.

On the other hand, when the air conditioner is stopped, the motor 242' of the X-link diffraction mechanism 240' is driven in a door close mode, and the exhaust vane driving mechanism is driven so that the exhaust vane(s) 115 shield the air outlet(s) 112. The fan motor 12 of the blower 12 is also stopped. If the motor 242' of the X-link diffraction mechanism 240' is driven in the door close mode, the motor 242' may rotate the driving gear 244' connected to the rotary shaft 151 in the direction opposite to that when the door panel 300 is opened, and the driven gear 246' rotatably mounted to the X-link 232 may be descended along the circular track at the outside of the driving gear 244' while being rotated along the driving gear 244'. In this case, the horizontal interval between the upper portions of the first and second links 233 and 234 and the horizontal interval between the lower portions of the first and second links 233 and 234 is increased, thereby folding the X-link 232.

When the X-link 232 is folded as described above, the X-link 232 pulls the door panel 300 upward. The door panel 300 is ascended while the guide device 310 is guided to the inlet panel 200 so that the air suction flow path P is gradually narrowed. The door panel 30 reaches the position at which the door panel 300 is maximally ascended, i.e., the position at which the gap between the inlet panel 200 and the door panel 300 is not visible from the outside.

Figure 19:
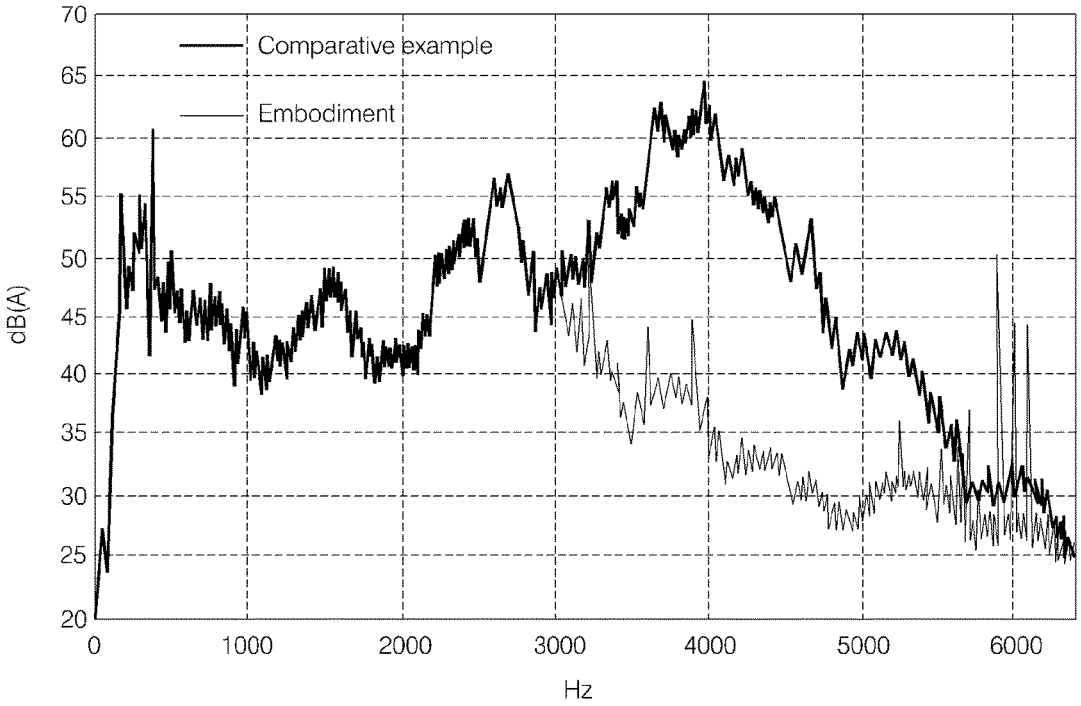
FIG. 19 is a graph comparing measured noise values of an air conditioner as embodied and broadly described herein and an exemplary air conditioner.

FIG. 19 is a graph comparing measured noise values of an air conditioner as embodied and broadly described herein and a comparative example. That is, in FIG. 19, noise spectra of an air conditioner as embodied and broadly described herein and a comparative example that does not include the protruding portions and recessed portions on a bell mouth, as described above with respect to the various embodiments are compared. As shown in FIG. 19, noise generated in a high-frequency region (3000 Hz to 5500 Hz) may be remarkably reduced as compared to the comparative example by a bell mouth including the protruding and recessed portions as embodied and broadly described herein.

Figure 20:
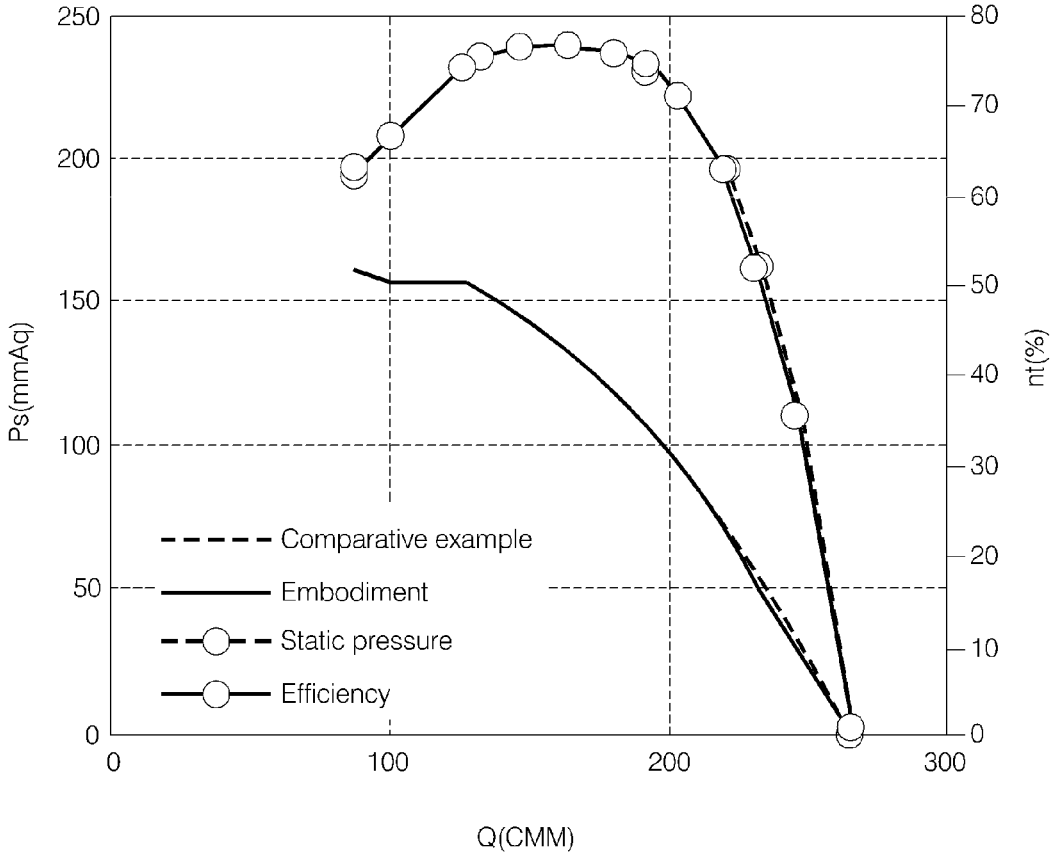
FIG. 20 is a graph comparing efficiency and performance of an air conditioner as embodied and broadly described herein and an exemplary air conditioner.

FIG. 20 is a graph comparing efficiency and performance of an air conditioner as embodied and broadly described herein and the comparative example not including the protruding portions and the recessed portions, in which performance and efficiency at the same RPM and using the same centrifugal fan are measured.

As shown in FIG. 20, performance (static pressure) and efficiency of the embodiment and the comparative example are very similar to each other. Thus, it may be possible to reduce noise in a high-frequency region, caused when the centrifugal fan is rotated at a high speed, while maintaining the performance and efficiency of the centrifugal fan.

A centrifugal blower and an air conditioner using the same are provided in which noise of a centrifugal fan may be reduced and efficiency of the centrifugal blower may be improved.

An air conditioner is provided in which a door panel may ascend and descend using a simple structure.

A centrifugal blower as embodied and broadly described herein may include a fan motor; a centrifugal fan rotatably coupled to the fan motor so as to suck air at one side thereof and exhaust the sucked air to the other side thereof; and a bell mouth guiding the air sucked into the centrifugal fan, and divided into a front portion positioned at the axial direction front F and a rear portion positioned at the axial direction rear R, wherein the centrifugal fan includes: a hub fixed to a rotary shaft; a main plate formed on an outer circumferential surface of the hub; a shroud having a suction opening opened about the rotary shaft, and disposed opposite to the main plate toward the axial direction front with respect to the main plate so as to form the path of a main gas flow; and a plurality of wings arranged along the circumferential direction of the suction opening between the main plate and the shroud, wherein the bell mouth portions arranged opposite to the shroud at the axial direction front with respect to the shroud, wherein the bell mouth includes: a portion of the rear portion inserted into the shroud through the suction opening in a state in which the rear portion forms a predetermined gap with the suction opening, a plurality of protruding portions, formed at an end of the rear portion; and a plurality of recessed portions formed between the protruding portions, and wherein the protruding portions and the recessed portions are inserted into the shroud.

The protruding portion and the recessed portion may be formed symmetric to each other.

The protruding portion may include two sloped surfaces inclined with respect to the axial direction, and the width between the sloped surfaces may be narrowed as the sloped surface approaches from the axial direction front to the axial direction rear.

The height D of the bell mouth, the height H of the protruding portion, the bottom side S of the protruding portion (the width of the protruding portion) and the top side L of the protruding portion satisfy the relational expressions (1), (2) and (3) set forth herein.

The centrifugal fan may further include an extending plate formed between the hub and the main plate so as to provide a space in which the fan motor is positioned. The extending plate may further include a heat dissipation hole forming a motor heat dissipation flow between the main plate and the shroud in the space in which the fan motor is positioned in order to dissipate heat of the fan motor; and a direction changing portion changing the direction of the motor heat dissipation flow exhausted through the heat dissipation hole between the axial direction rear and an axial direction side.

According to another embodiment as broadly described herein, there is provided an air conditioner including the centrifugal blower.

The air conditioner may further include a door panel covering the air inlet. The door panel may descend to allow the air inlet to communicate with the outside, and may ascend to shield the air inlet.

In a centrifugal blower as embodied and broadly described herein, when pressure is low and an amount of air is large, the protruding portions and the recessed portions may reduce noise in a high-frequency region, caused by turbulence generated between the shroud of the centrifugal fan and the rear portion of the bell mouth.

Also, the centrifugal blower as embodied and broadly described herein may experience little to no degradation of performance and efficiency mouth.

Also, the direction of the motor heat dissipation flow exhausted through the heat dissipation hole may be changed to a direction similar to that of the main gas flow, so that collision between the main gas flow and the motor heat dissipation flow may be reduced, thus reducing noise generated by such flow collision.

Also, since the main gas flow and the motor heat dissipation flow do not interfere with each other, the main gas flow and the motor heat dissipation flow may be increased.

This increased main gas flow may increase the amount of air exhausted by passing through the heat exchanger, and improve performance of the air conditioner.

This increased motor heat dissipation flow B may more efficiently cool the fan motor.

Also, as the X-link raises the door panel and limits the descending height of the door panel, the number of components of the air conditioner may be minimized and the structure may be simplified.

Also, the X-link diffraction mechanism may be mounted on the upper surface of the inlet panel so that the inlet panel covers the X-link diffraction mechanism. Thus, the external appearance of the air conditioner may be improved, and the X-link diffraction mechanism does not interfere with the suction of indoor air.

Also, since the upper portion of the X-link may move rectilinearly, utilization of space above the inlet panel may be improved, and the ascending width of the door panel due to the X-link may be maximized while shortening the length of the X-link.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A centrifugal blower, comprising:
a motor;
a centrifugal fan rotatably coupled to the motor, the centrifugal fan comprising:
a hub fixed to a rotary shaft of the motor;
a main plate provided at an outer circumferential surface of the hub;
a shroud position opposite the main plate, upstream of the main plate, the shroud having a suction opening formed therein surrounding the rotary shaft; and
a plurality of wings arranged in a circumferential direction of the suction opening, in a space formed between the main plate and the shroud; and
a bell mouth positioned upstream of the centrifugal fan and guiding air into the centrifugal fan, wherein the bell mouth comprises:
a rear portion inserted into the shroud through the suction opening such that the rear portion forms a predetermined radial gap with the suction opening;
a plurality of protrusions formed at a rear end of the rear portion; and
a plurality of recesses respectively formed between the plurality of protrusions, wherein the plurality of protrusions and the plurality of recesses are inserted into the shroud, wherein the bell mouth is inserted into the shroud with a depth two to four times greater than an average height of the plurality of protrusions, wherein the centrifugal fan further comprises an extending plate provided between the hub and the main plate so as to form a space in which the motor is positioned, wherein the extending plate comprises:
at least one heat dissipation hole formed therethrough, wherein the at least one heat dissipation hole defines a motor heat dissipation flow path between the main plate and the shroud, the motor heat dissipation flow path guiding heat generated by the motor; and
at least one direction changing device provided on the extending plate, at a position corresponding to the at least one heat dissipation hole, to change a direction of the motor heat dissipation flow discharged in a rear axial direction to a radial direction, wherein the at least one direction changing device has a first end connected to the extending plate and a second end spaced apart from the extending plate, and extends to cover at least the at least one heat dissipation hole, wherein an area of the at least one direction changing device is greater than an area of the at least one heat dissipation hole, and wherein the at least one direction changing device has a ring shape formed about the rotary shaft of the fan motor.

2. The centrifugal blower of claim 1, wherein the bell mouth defines an air flow opening that guides air into the centrifugal fan, wherein the air flow opening is defined by an air guide surface formed in a curved shape.

3. The centrifugal blower of claim 2, wherein a diameter of the air flow opening of the bell mouth gradually decreases from a front axial end of the bell mouth to a rear axial end of the bell mouth, and a curvature of the air guide surface corresponds to a diameter of the bell mouth.

4. The centrifugal blower of claim 3, wherein the bell mouth and the centrifugal fan are concentrically arranged.

5. The centrifugal blower of claim 4, wherein the rear end of the rear portion of the bell mouth forms a rear edge of the air flow opening.

6. The centrifugal blower of claim 2, wherein each of the plurality of protrusions has a triangular shape or a quadrangular shape.

7. The centrifugal blower of claim 2, wherein each of the plurality of recesses has a triangular shape or a quadrangular shape.

8. The centrifugal blower of claim 2, wherein the plurality of protrusions and the plurality of recesses are symmetrically formed.

9. The centrifugal blower of claim 2, wherein each of the plurality of protrusions comprises two sloped surfaces that are inclined with respect to an axial direction of the bell mouth, and wherein a distance between the two sloped surfaces is gradually narrowed as the sloped surfaces progress from a front axial end of the bell mouth to a rear axial end of the bell mouth.

10. The centrifugal blower of claim 8, wherein an overall height D of the bell mouth and a height H of the plurality of protrusions satisfy the expression $$0.01 \leq \frac{H}{D} \leq 0.015.$$

11. The centrifugal blower of claim 8, wherein a height D of the plurality of protrusions and a width S of a bottom end of the plurality of protrusions satisfy the expression $$0.02 \leq \frac{S}{D} \leq 0.04.$$

12. The centrifugal blower of claim 8, wherein a width S of a bottom end of the plurality of protrusions and a width L of a top end of the plurality of protrusions satisfy the expression $$0 \leq \frac{L}{S} \leq 1.$$

13. An air conditioner, comprising:
a main body;
a centrifugal blower provided in the main body;
a heat exchanger provided in the main body, surrounding the centrifugal blower; and
an inlet/outlet panel assembly movably coupled to the main body, and dividing an inside of the main body into a suction region and an exhaust region, the inlet/outlet panel assembly having an air inlet that guides air into the main body, wherein the centrifugal blower comprises:
a motor;
a centrifugal fan rotatably coupled to the motor, wherein the centrifugal fan comprises:
a hub fixed to a rotary shaft of the motor;
a main plate provided at an outer circumferential surface of the hub;
a shroud positioned upstream of the main plate, opposite the main plate, and having a suction opening formed therein surrounding the rotary shaft; and a plurality of wings arranged circumferentially with respect to the suction opening, between the main plate and the shroud; and a bell mouth guiding air into the centrifugal fan, wherein the bell mouth comprises:

a rear portion inserted into the shroud through the suction opening such the rear portion forms a predetermined radial gap with the suction opening;

a plurality of protrusions formed at a rear end of the rear portion; and a plurality of recesses respectively formed between the plurality of protrusions, wherein the plurality of protrusions and the plurality of recesses are inserted into the shroud, wherein the bell mouth is inserted into the shroud with a depth two to four times greater than an average height of the plurality of protrusions, wherein the centrifugal fan further comprises an extending plate provided between the hub and the main plate so as to form a space in which the motor is positioned, wherein the extending plate comprises:

at least one heat dissipation hole formed therethrough, wherein the at least one heat dissipation hole defines a motor heat dissipation flow path between the main plate and the shroud, the motor heat dissipation flow path guiding heat generated by the motor; and at least one direction changing device provided on the extending plate, at a position corresponding to the at least one heat dissipation hole, to change a direction of the motor heat dissipation flow discharged in a rear axial direction to a radial direction, wherein the at least one direction changing device has a first end connected to the extending plate and a second end spaced apart from the extending plate, and extends to cover at least the at least one heat dissipation hole, wherein an area of the at least one direction changing device is greater than an area of the at least one heat dissipation hole, and wherein the at least one direction changing device has a ring shape formed about the rotary shaft of the fan motor.

14. The air conditioner of claim 13, further comprising a door panel movably coupled relative to the main body and selectively covering the air inlet.

15. The air conditioner of claim 14, wherein the inlet/outlet panel assembly comprises:

an inlet panel having the air inlet formed therein; and an outlet panel coupled to the inlet panel and having at least one air outlet formed therein.

16. The air conditioner of claim 15, wherein, in a raised position of the door panel, the door panel and the outlet panel form a lower exterior surface of the air conditioner, and in a lowered position of the door panel, a gap is formed between the door panel and the inlet/outlet panel assembly such that air is introduced into the main body through the gap and the air inlet formed in the inlet panel.

17. The air conditioner of claim 16, further comprising a raising/lowering mechanism that movably couples the door panel to the main body, the raising/lowering mechanism comprising:

a first link;

a second link rotatably coupled to the first link at respective central portions thereof; and an actuation mechanism operably coupled to upper ends of the first and second links, wherein the upper ends of the first and second links are movably coupled to the inlet panel, and lower ends of the first and second links are movably coupled to the door panel.

18. The air conditioner of claim 17, wherein, in a door lowering mode, the actuation mechanism is configured to move the upper ends of the first and second links toward each other so as to unfold the first and second links and move the door panel away from the outlet panel to the lowered position of the door panel, and, in a door raising mode, the actuation mechanism is configured to move the upper ends of the first and second links apart from each other so as to fold the first and second links and move the door panel toward the outlet panel to the raised position of the door panel.

* * * * *